US010130960B2

(12) United States Patent
Gopalan et al.

(10) Patent No.: US 10,130,960 B2
(45) Date of Patent: Nov. 20, 2018

(54) SWIRL NOZZLE ASSEMBLIES WITH HIGH EFFICIENCY MECHANICAL BREAK UP FOR GENERATING MIST SPRAYS OF UNIFORM SMALL DROPLETS

(71) Applicants: Shridhar Gopalan, Westminster, MD (US); Evan Hartranft, Bowie, MD (US)

(72) Inventors: Shridhar Gopalan, Westminster, MD (US); Evan Hartranft, Bowie, MD (US)

(73) Assignee: dlhBOWLES, Inc., Canton, OH (US)

( * ) Notice: Subject to any disclaimer, the term of this patent is extended or adjusted under 35 U.S.C. 154(b) by 0 days.

(21) Appl. No.: 15/303,429

(22) PCT Filed: Mar. 24, 2015

(86) PCT No.: PCT/US2015/022262

§ 371 (c)(1),
(2) Date: Oct. 11, 2016

(87) PCT Pub. No.: WO2015/148517

PCT Pub. Date: Oct. 1, 2015

(65) Prior Publication Data

US 2017/0065990 A1 Mar. 9, 2017

Related U.S. Application Data

(60) Provisional application No. 61/969,442, filed on Mar. 24, 2014, provisional application No. 62/022,290, filed on Jul. 9, 2014.

(51) Int. Cl.
*B05B 17/04* (2006.01)
*B05B 1/34* (2006.01)
(Continued)

(52) U.S. Cl.
CPC ..... *B05B 1/3436* (2013.01); *B05B 11/30* (2013.01); *B65D 83/20* (2013.01); *B65D 83/14* (2013.01)

(58) Field of Classification Search
CPC ..... B05B 1/3405; B05B 1/3436; B05B 11/30; B05B 11/301; B65D 83/14; B65D 83/20
(Continued)

(56) References Cited

U.S. PATENT DOCUMENTS 3,771,728 A * 11/1973 Polnauer ..... F23D 11/383 239/468
4,074,861 A 2/1978 Magers
(Continued)

FOREIGN PATENT DOCUMENTS

| | | |
|---|---|---|
| EP | 0661069 | 7/1995 |
| EP | 2415690 | 2/2012 |
| GB | 2244013 | 11/1991 |

OTHER PUBLICATIONS

International Searching Authority, U.S. Patent Office, International Search Report and Written Opinion for International App. No. PCT/US2015/022262 dated Jun. 22, 2015.
European Patent Office; Extended European Search Report for European Pat. App. 15768586.8; dated Oct. 16, 2017.

*Primary Examiner* — Steven J Ganey
(74) *Attorney, Agent, or Firm* — McDonald Hopkins LLC

(57) ABSTRACT

A spray dispenser is configured to generate a swirled output spray pattern 152 with improved rotating or angular velocity ω and smaller sprayed droplet size. Cup-shaped nozzle member 60 has a cylindrical side wall 62 surrounding a central longitudinal axis 64 and has a circular closed end wall 68 with at least one exit aperture 74 passing through the end wall. At least one enhanced swirl inducing mist generating structure is formed in an inner surface 70 of the end wall, and including a pair of opposed inwardly tapered offset
(Continued)

High Efficiency Mechanical Break Up Nozzle

High Efficiency Mechanical Break Up Nozzle power nozzle channels 80, 82 terminating in an interaction chamber 84 surrounding the exit aperture 74. The power nozzle channels generate opposing offset flows which are aimed to very efficiently generate a vortex of fluid which projects distally from the exit aperture as a swirled spray of small droplets 152 having a rapid angular velocity.

21 Claims, 11 Drawing Sheets

(51) Int. Cl.
*B65D 83/20* (2006.01)
*B05B 11/00* (2006.01)
*B65D 83/14* (2006.01)

(58) Field of Classification Search
USPC ..... 239/11, 333, 337, 490–492, 494, 496, 239/497, 463, 468
See application file for complete search history.

(56) References Cited

U.S. PATENT DOCUMENTS 4,489,890 A * 12/1984 Martin ..... B05B 11/3011 239/333
4,979,678 A 12/1990 Ruscitti
5,411,185 A * 5/1995 Drobish ..... B05B 1/1645 222/402.17
5,622,318 A * 4/1997 Bougamont ..... B05B 1/3436 239/490
5,711,488 A * 1/1998 Lund ..... B05B 1/3436 239/492
6,142,390 A * 11/2000 Nordstrom ..... B05B 1/14 239/497
8,844,843 B2 9/2014 Horiuchi
2001/0011687 A1* 8/2001 Benoist ..... B05B 1/3436 239/492
2008/0315016 A1 12/2008 Octeau

* cited by examiner

Diagram of fluid swirling inside MBU Nozzle Interacton Region

High Efficiency Mechanical Break Up Nozzle

High Efficiency Mechanical Break Up Nozzle

Equal Rotational Orientation

Opposite Rotational Orientation

High Flow Embodiment with Diverging Throats

Cumulative droplet size distribution Plot, 10 dual swirl nozzles.

Cumulative droplet size distribution Data, 10 dual swirl nozzles.

| | Sample | Dx(10) | Dx(50) | Dx(90) | Cv(%) | Lot |
|---|---|---|---|---|---|---|
| [V] | D SMC A4-1 CG 9 in | 29.21 | 61.48 | 109.72 | 0.0075 | |
| [V] | D SMC A4-2 CG 9 in | 28.46 | 62.08 | 110.62 | 0.0079 | |
| [V] | D SMC A4-3 CG 9 in | 29.41 | 59.41 | 106.95 | 0.0148 | |
| [V] | D SMC A4-4 CG 9 in | 25.42 | 58.84 | 111.60 | 0.0148 | |
| [V] | D SMC A4-5 CG 9 in | 31.05 | 60.05 | 103.69 | 0.0081 | |
| [V] | D SMC A4-6 CG 9 in | 25.04 | 57.39 | 108.92 | 0.0052 | |
| [V] | D SMC A4-7 CG 9 in | 27.80 | 61.31 | 113.50 | 0.0144 | |
| [V] | D SMC A4-8 CG 9 in | 30.61 | 61.09 | 108.44 | 0.0174 | |
| [V] | D SMC A4-9 CG 9 in | 26.28 | 59.64 | 109.56 | 0.0086 | |
| [V] | D SMC A4-10 CG 9 in | 29.21 | 63.47 | 112.14 | 0.0089 | |

[V]=Volume [N]=Number

Frequency droplet size distribution plot, 10 dual swirl nozzles.

Frequency droplet size distribution data, 10 dual swirl nozzles.

| | Sample | Dx(10) | Dx(50) | Dx(90) | Cv(%) | Lot |
|---|---|---|---|---|---|---|
| [V] | D SMC A4-1 CG 9 in | 29.21 | 61.48 | 109.72 | 0.0075 | |
| [V] | D SMC A4-2 CG 9 in | 28.46 | 62.08 | 110.62 | 0.0079 | |
| [V] | D SMC A4-3 CG 9 in | 29.41 | 59.41 | 106.95 | 0.0148 | |
| [V] | D SMC A4-4 CG 9 in | 25.42 | 58.84 | 111.60 | 0.0148 | |
| [V] | D SMC A4-5 CG 9 in | 31.05 | 60.05 | 103.69 | 0.0081 | |
| [V] | D SMC A4-6 CG 9 in | 25.04 | 57.39 | 108.92 | 0.0052 | |
| [V] | D SMC A4-7 CG 9 in | 27.80 | 61.31 | 113.50 | 0.0144 | |
| [V] | D SMC A4-8 CG 9 in | 30.61 | 61.09 | 108.44 | 0.0174 | |
| [V] | D SMC A4-9 CG 9 in | 26.28 | 59.64 | 109.56 | 0.0086 | |
| [V] | D SMC A4-10 CG 9 in | 29.21 | 63.47 | 112.14 | 0.0089 | |

[V]=Volume [N]=Number

SWIRL NOZZLE ASSEMBLIES WITH HIGH EFFICIENCY MECHANICAL BREAK UP FOR GENERATING MIST SPRAYS OF UNIFORM SMALL DROPLETS

REFERENCE TO RELATED APPLICATIONS

This is a Continuation application which claims priority under 35 U.S.C. 120 and 35 U.S.C. 111(a) as the U.S. National Phase under 35 USC 371 of PCT/US2015/022262, filed Mar. 24, 2015; published, in English, as WO 2015/148517 on Oct. 1, 2015 and also claims priority to U.S. provisional patent application 62/022,290 filed Jul. 9, 2014 and U.S. provisional patent application 61/969,442 filed Mar. 24, 2014, the entire disclosures of which are expressly incorporated herein by reference. This application is also related to commonly owned U.S. Pat. No. 7,354,008 entitled "Fluidic Nozzle for Trigger Spray Applications" and PCT application number PCT/US12/34293, entitled "Cup-shaped Fluidic Circuit, Nozzle Assembly and Method" issued on Apr. 8, 2008 to Hester et al (now WIPO Pub WO 2012/145537). The entire disclosures of all of the foregoing applications and patents are hereby incorporated herein by reference.

BACKGROUND OF THE INVENTION

Field of the Invention

The present invention relates, in general, to spray nozzles configured for use when spraying consumer goods such as air fresheners, cleaning fluids, personal care products and the like. More particularly, this invention relates to a fluidic nozzle assembly for use with low-pressure, trigger spray or "product only" (meaning propellant-less) applicators or nozzles for pressurized aerosols (especially Bag-On-Valve and Compressed Gas packaged products).

Discussion of the Prior Art

Generally, a trigger dispenser for spraying consumer goods is a relatively low-cost pump device for delivering liquids from a container. The dispenser is held in the hand of an operator and has a trigger that is operable by squeezing or pulling the fingers of the hand to pump liquid from the container and through a spray head incorporating a nozzle at the front of the dispenser.

Such manually-operated dispensers may have a variety of features that have become common and well known in the industry. For example, a prior art dispenser may incorporate a dedicated spray head having a nozzle that produces a defined spray pattern for the liquid as it is dispensed or issued from the nozzle. It is also known to provide nozzles having adjustable spray patterns so that with a single dispenser the user may select a spray pattern that is in the form of either a stream or a substantially circular or conical spray of liquid droplets.

Many substances are currently sold and marketed as consumer goods in containers with such trigger-operated spray heads, as shown in FIGS. 1A-1C. Examples of such substances include air fresheners, window cleaning solutions, carpet cleaners, spot removers, personal care products, weed and pest control products, and many other materials useful in a wide variety of spraying applications. Consumer goods using these sprayers are typically packaged with a bottle that carries a dispenser which typically includes a manually actuated pump that delivers a fluid to a spray head nozzle which a user aims at a desired surface or in a desired direction. Although the operating pressures produced by such manual pumps are generally in the range of 30-40 psi, the conical sprays are typically very sloppy, and spray an irregular pattern of small and large drops.

Sprayer heads recently have been introduced into the marketplace which have battery operated pumps in which one has to only press the trigger once to initiate a pumping action that continues until pressure is released on the trigger. These typically operate at lower pressures in the range of 5-15 psi. They also suffer from the same deficiencies as noted for manual pumps; plus, they generally have even less variety in or control of the spray patterns that can be generated due to their lower operating pressures.

Aerosol applications are also common and now use Bag-On-Valve ("BOV") and compressed gas methods to develop higher operating pressures, in the range of, e.g., 50-140 psi rather than the previously-used costly and less environmentally friendly propellants. These packaging methods are desired because they can produce higher operating pressures compared to the other delivery methods, as mentioned above.

The nozzles for typical commercial dispensers are typically of the one-piece molded "cap" variety, having channels producing either spray or stream patterns when the appropriate channel is lined up with a feed channel coming out of a sprayer assembly. These prior art nozzles are traditionally referred to as "swirl cup" nozzles inasmuch as the spray they generate is generally "swirled" within the nozzle assembly to form a spray (as opposed to a stream) having droplets of varying sizes and velocities scattered across a wide angle. Traditional swirl nozzles consist of two or more input channels positioned tangentially to an interaction region, or at an angle relative to the walls of the interaction region (see, e.g., FIGS. 2A and 2B). The interaction region may be either square, with specified length, width and depth dimensions, or circular, with specified diameter and depth dimensions. The standard swirl nozzle geometry requires a face seal and is arranged so that the flow exits the input channels and enters the interaction region with swirling or tangential velocity, setting up a vortex. The vortex then circulates downstream and leaves the interaction region through an exit which is typically concentric to the central axis of the nozzle assembly.

The problems with the prior art nozzle assemblies of FIGS. 1A-2B include: (a) a relative lack of control of the spray patterns generated, (b) frequent generation in such sprays of an appreciable number of both large and small diameter droplets which are randomly directed in a generally distal direction, and (c) a tendency of the resulting spray patterns to create sprayed areas pelted with large high velocity liquid droplets which result in the sprayed liquid splattering or collecting in pools that produce undesirable, break-out portions that stream down a sprayed surface. Sprays with large droplets are particularly undesirable if the user seeks to spray only a fine mist of liquid product. Droplets comprising a "mist spray" preferably have a diameter of eighty micrometers (80 μm) or less, but should be larger than 10 μm to avoid inhalation hazards; however, prior art swirl cups cannot reliably create misting sprays with droplets of the desired size range of, e.g., 60-80 μM.

As described in the above-mentioned commonly owned U.S. Pat. No. 7,354,008 to Hester et al, a spray head nozzle for the above-described dispensers may incorporate a fluidic device that can, without any moving parts, yield any of a wide variety of spray patterns having a desired droplet size and distribution. Such devices include fluidic circuits having liquid flow channels that produce desirable flow phenomena, and such circuits are described in numerous patents. The Hester patent describes fluid circuits for low pressure trigger spray devices.

Swirl nozzles are used in numerous applications. The primary function is generating an atomized spray with a preferred droplet size distribution. For many applications, it is preferred that the sprayed droplet Volumetric Median Diameter (VMD or DV50) and domain of the distribution be as small as possible. It is also desired to minimize the operating pressure required to generate a preferred level of atomization. There is a need, therefore, for a cost effective substitute for the traditional swirl cup, which will reliably generate droplets of a selected small size so as to avoid the splattering and other disadvantages of large droplet creation by traditional swirl cups in relatively high pressure applications such as hand operated pumps that can generate pressures in the range of 30-40 psi, or for "BOV" and compressed gas devices that develop higher operating pressures, in the range of, e.g., 50-140 psi.

SUMMARY OF THE INVENTION

The applicants have studied the prior art swirl cup nozzles (e.g., as illustrated in FIGS. 2A and 2B) and have now identified the reasons that they provide such a messy spray. As noted above, those traditional swirl nozzles consists of one or more input channels or power nozzles having specified width and depth dimensions, positioned tangentially to an interaction region, or at an angle relative to the walls of the interaction region. The interaction region is either square with a desired length, width and depth dimension, or is circular, with desired diameter and depth dimensions. The geometry of the nozzle requires a face seal where it abuts the spray head so that the outlet fluid is supplied to the cup inlet. The traditional swirl cup is designed so that the flow exits the power nozzles and enters the interaction region with a tangential velocity $U\theta$, setting up a fluid vortex with radius "r" and an angular velocity $\omega=U\theta/r$. The fluid vortex then circulates downstream and exits the interaction region through an exit opening that is concentric to the central axis of the nozzle. This traditional swirl cup configuration causes the droplets generated in the swirl chamber to accelerate distally along the tubular lumen of the exit and to coagulate or recombine into droplets of irregular large sizes having excessive distally projected linear velocity, causing a poor misting performance.

After identifying the problems causing this poor misting performance of the prior art swirl cup nozzles, the applicants herein developed a new nozzle assembly which avoids these problems while maximizing the creation and preservation of small droplets which are issued at a very high angular velocity.

The High Efficiency Mechanical Break Up ("HE-MBU") nozzle assembly of the present invention includes two unique features which differ significantly when compared to traditional swirl nozzle geometry of the prior art. These newly developed features reduce internal shear losses and improve and maintain resultant spray atomization. Improved spray atomization is characterized by increasing angular velocity "$\omega$" for a given input pressure, resulting in generation and maintenance of smaller droplets. In addition to $\omega$, a number of other factors influence the atomization or VMD of the spray output, such as coagulation. Coagulation is a phenomenon where small drops collide and recombine downstream of the nozzle exit, and by recombining, form larger drops than ones generated at the nozzle exit. As a result, VMD increases as the distance of the measurement location from the nozzle exit increases. This phenomena is undesirable when the application calls for a fine mist (e.g., as used in many hair care products).

Hence, a first embodiment of the present invention includes two principal improvements over traditional swirl nozzle of the prior art, namely: (1) a swirled spray with significantly increased rotating or angular velocity $\omega$, resulting in smaller droplet size, and (2) a distally projecting swirling spray with reduced coagulation, further reducing & maintaining smaller droplet size.

Briefly, then, in a preferred form of the invention, a nozzle for a spray dispenser is configured to generate a swirled output spray pattern with improved rotating or angular velocity $\omega$, resulting in smaller sprayed droplet size. A cup-shaped nozzle body has a cylindrical side wall surrounding a central longitudinal axis and has a circular closed end wall with at least one exit aperture passing through the end wall. At least one enhanced swirl inducing mist generating structure is formed in an inner surface of the end wall, with the fluidic circuit including a pair of opposed inwardly tapered offset power nozzle chambers terminating in an interaction region surrounding the exit aperture. The power nozzle chambers are offset in opposite directions with respect to the transverse axis of the exit aperture, whereby fluid under pressure introduced into the fluidic chamber accelerates along the power nozzle chambers into the interaction region to generate a swirling fluid vortex which exits the exit aperture as a swirling spray. Each power nozzle chamber is defined by a continuous, smooth, curved wall and has a selected depth Pd defined by the height of the wall, with each power nozzle's sidewalls tapering generally inwardly from an enlarged region at the inlet, narrowing toward the interaction region to accelerate fluid flow. The power nozzle chambers each have a minimum exit width Pw at their intersection with the interaction region, and in selected embodiments have an aspect ratio equal to or less than 1 at the intersection.

More particularly, in one embodiment of the invention, a cup-shaped nozzle for spray-type dispensers has a substantially cylindrical sidewall surrounding a central axis, and a substantially circular distal end wall having an interior surface and an exterior, or distal, surface with a central outlet, or exit aperture, which provides fluid communication between the interior and exterior of the cup. Defined in the interior surface of the distal wall is an enhanced swirl inducing mist generating structure which includes first and second opposing but offset power nozzles, each providing fluid communication to and terminating in a central interaction or swirl vortex generating chamber in the end wall and surrounding the exit aperture. Each power nozzle chamber defines a tapering channel or lumen of selected depth but narrowing width which terminates in a power nozzle outlet region or opening having a selected power nozzle width ($P_W$) at its intersection with the interaction chamber.

A first one of the power nozzles has an inlet which is defined in the interior surface of the distal, or end, wall proximate the cylindrical sidewall so that pressurized inlet fluid flows into the interior of the cup and distally along the sidewall to enter the first power nozzle inlet. The fluid enters and accelerates along the tapered lumen of first power nozzle to a nozzle outlet where the fluid enters one side of the interaction chamber. A second one of the power nozzles is similar to the first and also receives at its inlet pressurized fluid which is flowing distally along the interior of the cup and along its sidewall. The inlet fluid enters and accelerates along the tapered lumen of second power nozzle to the nozzle outlet, where it enters the opposite side of the interaction chamber.

The interaction or swirl region is defined in the interaction chamber between the opposing but offset power nozzle outlets and has a substantially circular section having a cylindrical sidewall aligned with the nozzle central axis and coaxially aligned with the central exit aperture, or orifice, which provides fluid communication between the interaction chamber and the exterior of the cup so that fluid product spray is directed distally or out along that central axis.

The input channels or power nozzles are elongated, extending from the region of the nozzle sidewall along respective axes toward the interaction region and varying in width Pw, tapering to a narrow exit region at the interaction region and having the selected depth Pd, The axes of the power nozzles are generally opposed, on opposite sides of the circular interaction chamber, and are offset in the same angular direction from the central exit orifice to inject pressurized fluid into the interaction region at another selected inflow angle relative to the central axis and the walls of the interaction region. The interaction region is preferably circular with a diameter which is in the range of 1.5 to 4 times the power nozzle outlet exit width $P_W$. The interaction chamber preferably has the same depth as each power nozzle, preferably has a face seal and preferably is arranged so that the fluid flows from the power nozzles and enters the interaction region tangentially, with a higher tangential velocity Uθ than the fluid entering the nozzle, thereby setting up a vortex with radius r and a higher angular velocity ω=Uθ/r. The rapidly spinning or swirling vortex then issues from interaction region through the exit aperture which in one embodiment is aligned with the central axis of the nozzle cup. This configuration causes mechanical breakup and rapidly swirling fluid droplets that are generated in the swirl chamber to accelerate into a highly rotational flow which sprays or issues from the exit orifice as very small droplets which are swirling and thus less likely to coagulate or recombine into larger droplets.

In an alternative embodiment developed to provide further improved atomization efficiency of the applicant's HE-MBU nozzle prototypes, angular velocity ω was also found to vary significantly and in sometimes surprising ways by varying power nozzle offset ratio "OR". The offset ratio "OR" is defined as Pw/IRd where outlet width ("$P_W$") is preferably about one third of the swirl chamber or interaction region's diameter ("IRd"). As described above, reducing the HE-MBU chamber depths was found to reduce flow rate & improve the atomization of newer prototypes of the High Efficiency Mechanical Break Up ("HE-MBU") of the present invention. Coincidently, as the power nozzle aspect ratio was reduced, the depth of the circuit was reduced. The early prototypes showed modest gains in atomization which were thought to be attributable to simply reducing the circuit depth, not the power nozzle aspect ratio. Significant additional gains were realized after experimenting with power nozzle offset ratios. Therefore, optimizing the offset ratio is now believed to be the best mechanism for enhancing the efficiency with which a mechanical break up nozzle atomizes fluid.

In accordance with the preferred method of the present invention, a High Efficiency Mechanical Break Up ("HE-MBU") nozzle assembly includes an enhanced swirl inducing mist generating structure having first and second opposing, offset power nozzle channels each having an outlet width ("$P_W$") which is preferably about one third of the swirl chamber or interaction region's diameter ("IRd"). The offset ratio "OR" is defined as Pw/IRd. Applicants have determined, through experiments and testing of prototypes that the optimal value of the offset ratio OR is 0.37 (having tested values ranging from 0.30 to 0.50). The optimal angle of attack was found to be substantially tangent to the adjacent segment of circumferential wall of the interaction region, and the optimal depth was found to be a depth which is as small as possible (limited by boundary layer effects which, at depths which are too small out weight the gains from reduced volume of the features) in the enhanced swirl inducing mist generating structure. For example, at the scale of a particular commercial air care fluid product nozzle being developed and evaluated, applicants have selected a depth of 0.20 mm. In this embodiment, the swirl chamber depth is the same depth as the power nozzles to minimize volume. Alternative embodiments are also contemplated. In the early prototype embodiments, all of the power nozzle channel and swirl chamber depths were selected to be the same, meaning the power nozzles and swirl chambers are all configured as fluid channels having single selected depth (e.g., 0.20 mm). An alternative embodiment would include a varying depth, providing a tapered or converging floor of the channels in the enhanced swirl inducing mist generating structure. Instead of having a constant depth for the power nozzle chambers and the interaction region or swirl chamber, having the depth of the power nozzles taper at a selected taper angle (becoming shallower in the direction of flow) to provide another swirl inducing mist generating structure which is believed likely to further improve atomization efficiency. The nozzles of the present invention can also have more than one enhanced swirl inducing mist generating structure in a single sprayer, meaning more than one (e.g., two or more) of the outlet orifices can be configured to generate simultaneous distally projecting sprays which each swirl a selected angular orientation (e.g., the same or opposing orientations), depending on the intended spray application.

With all of the foregoing embodiments, it is an object of the present invention to provide a cost effective substitute for traditional swirl cup dispenser assemblies which will reliably generate a swirling spray of droplets of a selected small size, preferably with a droplet diameter of 60-80 μM or less, but larger than 10 μM, where the swirling spray is generated in a manner which makes droplet recombination less likely so that the large recombined droplet creation of traditional swirl cups that produces undesirable spray effects, such as splattering is mitigated.

BRIEF DESCRIPTION OF THE DRAWINGS

The foregoing, and additional objects, features, and advantages of the present invention will be further understood from the following detailed description of preferred embodiments thereof, taken with the following drawings, in which.

DESCRIPTION OF THE INVENTION

Figure 1A:
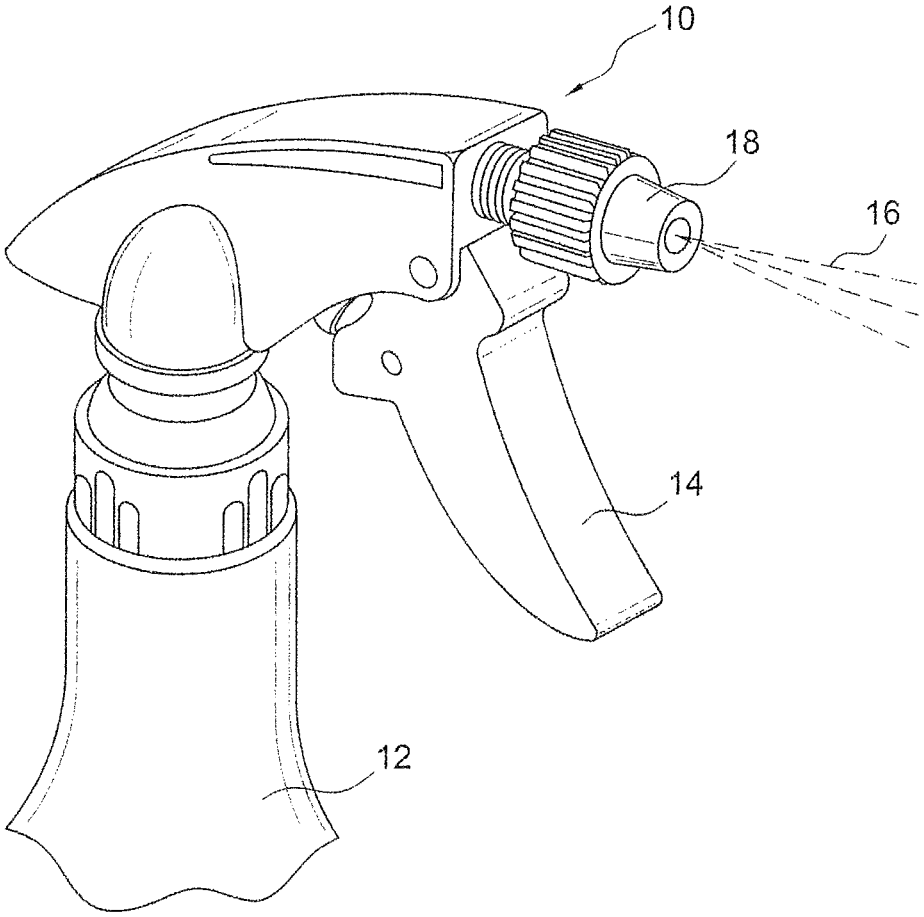
FIG. 1A (PRIOR ART)
FIG. 1A illustrates the spray head of a manual-trigger spray applicator in accordance with the prior art.
Figure 1B:
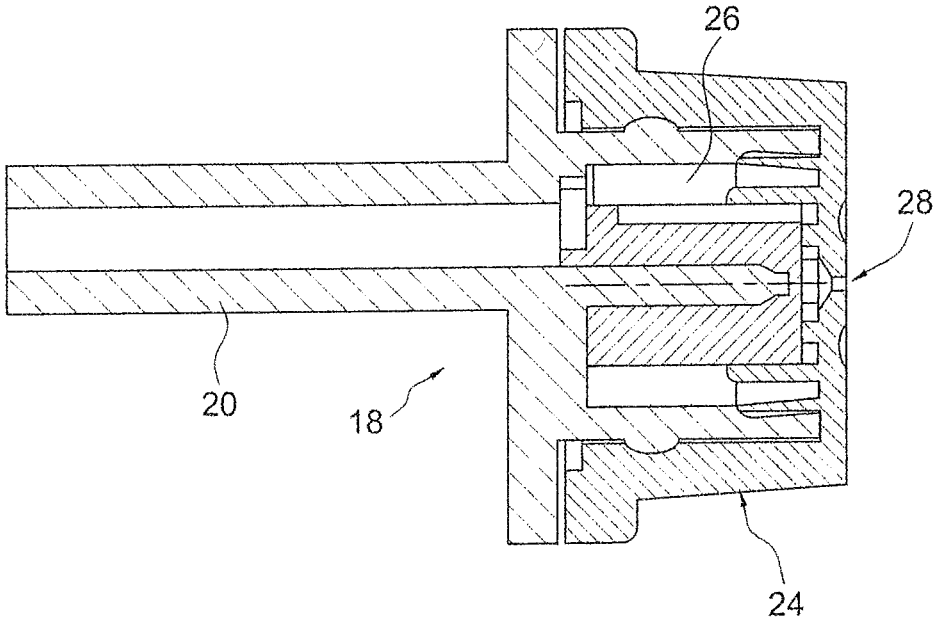
FIG. 1B (PRIOR ART)
FIGS. 1B and 1C illustrate the front portion and a cross-section of the front portion, respectively, of the device of FIG. 1.
Figure 1C:
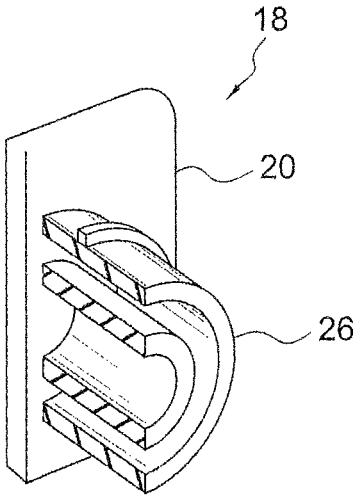
FIG. 1C (PRIOR ART)

Referring now to the Figures, wherein common elements are identified by the same numbers, FIGS. 1A, 1B and 1C illustrate a typical manually-operated trigger pump 10 secured to a container 12 of fluid to be dispensed, wherein the pump incorporates a trigger 14 activated by an operator to dispense fluid 16 through a nozzle 18. Such dispensers are commonly used, for example, to dispense a fluid from the container in a defined spray pattern or as a stream. Adjustable spray patterns may be provided so the user may select a stream or one of a variety of sprayed fluid droplets. A typical nozzle 18 is illustrated in cross-section in FIG. 1B and consists of tubular conduit 20 that receives fluid from the pump and directs it into a spray head portion 24, where the fluid travels through channels 26 and is ejected from orifice, or aperture 28. Details of the channels are illustrated in the cut-away view of FIG. 1C. Such devices are constructed as a one-piece molded plastic "cap" with channels that line up with the pump outlet to produce the desired stream or spray of a variety of fluids at pressures generally in the range of 30-40 psi. It has been found, however, that the patterns produced by such devices are hard to control and tend to produce at least some very small, fine droplets that often are entrained in the air, and can be harmful if inhaled. Further, such devices can produce areas of heavy coverage on a surface being sprayed which tend to cause undesirable pools or streams of liquid.

Figure 2A:
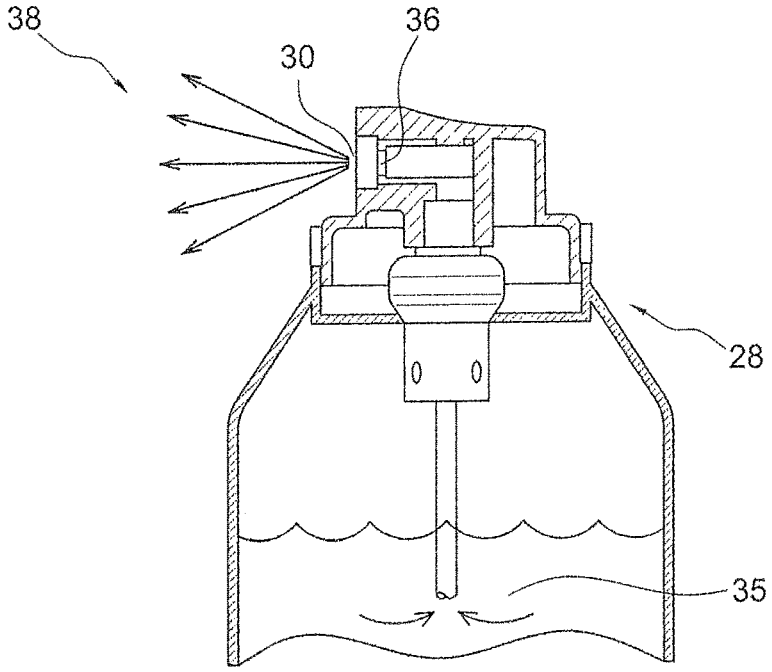
FIG. 2A (PRIOR ART)
FIGS. 2A and 2B illustrate typical features of prior art aerosol spray actuators having traditional swirl cup nozzles.
Figure 2B:
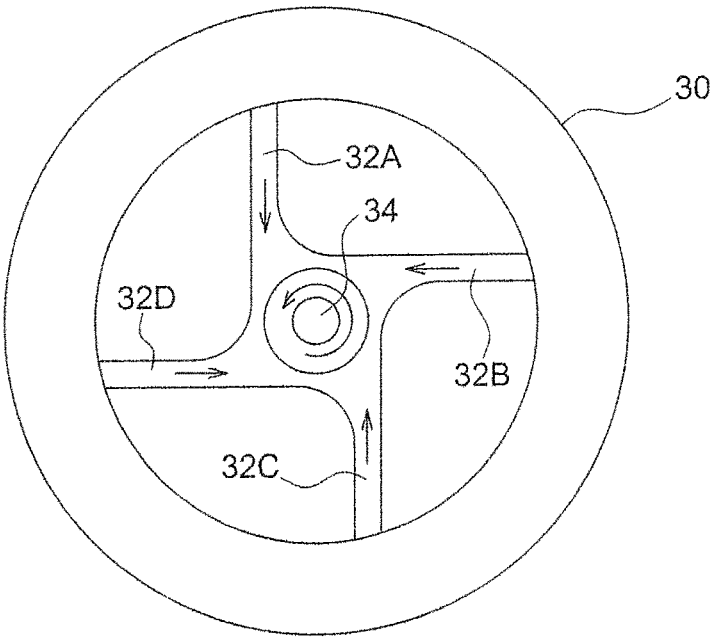
FIG. 2B (PRIOR ART)

FIGS. 2A and 2B illustrate a traditional swirl cup nozzle 30 for use with typical commercial dispenser 28. These prior art nozzles are traditionally referred to as "swirl cup" nozzles inasmuch as the spray they generate is generally "swirled" within the nozzle assembly to form a spray (as opposed to a stream) having droplets of varying sizes and velocities scattered across a wide angle. Traditional swirl nozzles consist of two or more input channels (32A, 32B, 32C, 32D) positioned tangentially to an interaction region, or at an angle relative to the walls of the interaction region (FIG. 2B). The interaction region may be either square, with specified length, width and depth dimensions, or circular, with specified diameter and depth dimensions. The standard cup-shaped swirl nozzle member 30 has an interior surface (seen in FIG. 2B) which abuts and seals against a face seal on a planar circular surface of distally projecting sealing post 36 and is arranged so that the flow of product fluid 35 flows into and through an annular lumen into the input channels 32A-32D and then flows into the central interaction region with swirling or tangential velocity, setting up a vortex. The fluid product vortex then circulates downstream and leaves the interaction region through an exit orifice 34 which is typically concentric to the central axis of the sealing post 36. The fluid product spray 38 issuing from or generated by the standard swirl cup nozzle assembly sprays irregular droplet sizes and splatters because this nozzle assembly inherently causes the droplet coagulation and droplet size uniformity problems described above. These problems were analyzed by the applicants who have discovered that parts of the standard nozzle assemblies can be used with a different fluid swirl inducing structure to generate much better spray generation performance.

To overcome the problems found in prior art sprayers of FIGS. 1A-2B, in accordance with the present invention, a swirl nozzle assembly is configured to generate a swirling spray of fine droplets (i.e., with a droplet diameter of 60-80 μM or less, but larger than 10 μM), with a high-efficiency mechanical breakup of the sprayed fluid product droplets, and then project that swirling spray in a selected direction along a distally aligned axis to provide mist sprays with small and uniform droplets. This required an enhanced understanding of the exact problems created by the prior art or traditional swirl cup (e.g., 30, of FIG. 2B). As diagrammatically illustrated at 40 in FIG. 3, swirl nozzles used in the prior art sprayers typically consist of one or more input channels (e.g., 32A-32D) positioned to supply pumped fluid tangentially, as indicated by arrow 42, to an interaction region 44; alternatively, the inlet channel may be at an angle relative to the walls of the interaction region. The interaction region 44 may be either square, with desired length, width and depth dimensions, or circular, with desired diameter and depth dimensions. In the illustration, the region 44 is circular with a radius "r". Typically, the geometry of the nozzle requires the face seal where it abuts the sealing post (e.g., 36) in the spray head so that outlet fluid from the spray head power nozzle is supplied to the cup inlet and enters the interaction region 44 with a tangential velocity Uθ, setting up a fluid vortex, indicated by arrow 46, having a maximum radius "r" and an angular velocity $\omega = U\theta/r$. The fluid vortex 46 circulates downstream and exits the interaction region through an exit opening having a tubular lumen 48 that is concentric to a central axis 50 of the nozzle. This configuration causes the droplets generated in the interaction region of the swirl chamber to accelerate distally along the tubular lumen of the exit orifice and to coagulate or recombine into droplets of irregular large sizes having excessive distally projected linear velocity, causing splattering and poor misting performance.

The fluidic nozzle assembly of the present invention incorporates the spray head and sealing post structure of the standard nozzle assembly, but discards the flawed performance of the standard swirl cup (e.g., 30). Thus, the present invention is directed to a new High-Efficiency Mechanical Break-Up ("HE-MBU") nozzle assembly, illustrated in FIGS. 4-9, which avoids these problems while maximizing the creation and preservation of small droplets which are distally sprayed or issued at a very high angular velocity. A first embodiment of the present invention provides two principal improvements over spray generation performance of traditional swirl nozzles of the prior art, namely: (1) a swirled spray with Increased rotating or angular velocity ω, resulting in smaller droplet size, and (2) a swirled spray with reduced coagulation, further reducing & maintaining smaller droplet size in the fluid product spray.

Figure 4:
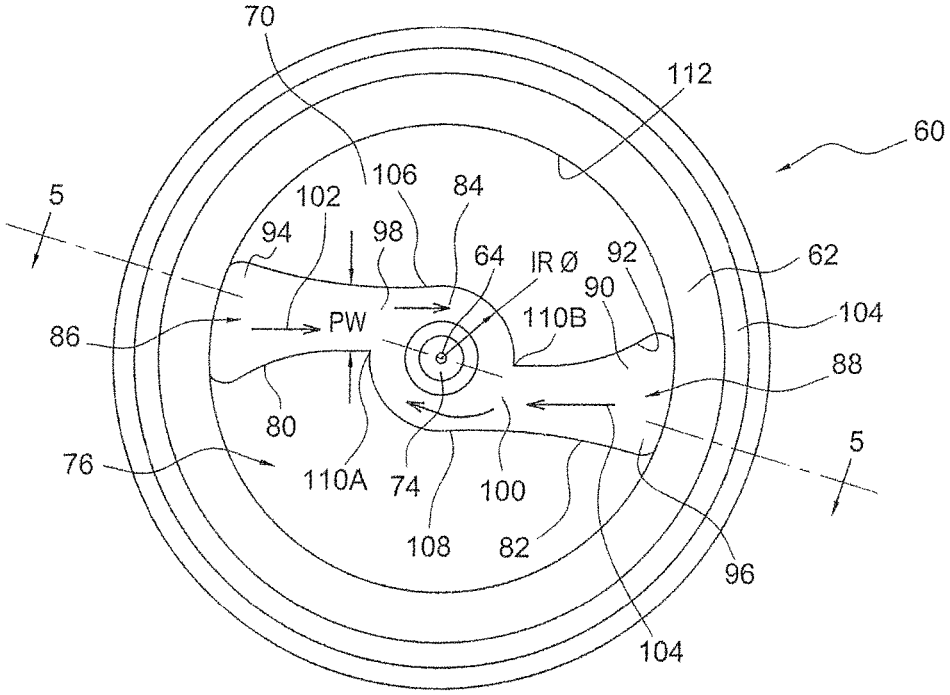
FIG. 4 is a bottom plan view illustrating a first embodiment of the High-Efficiency Mechanical Break-Up ("HE-MBU") nozzle of the present invention.
Figure 5:
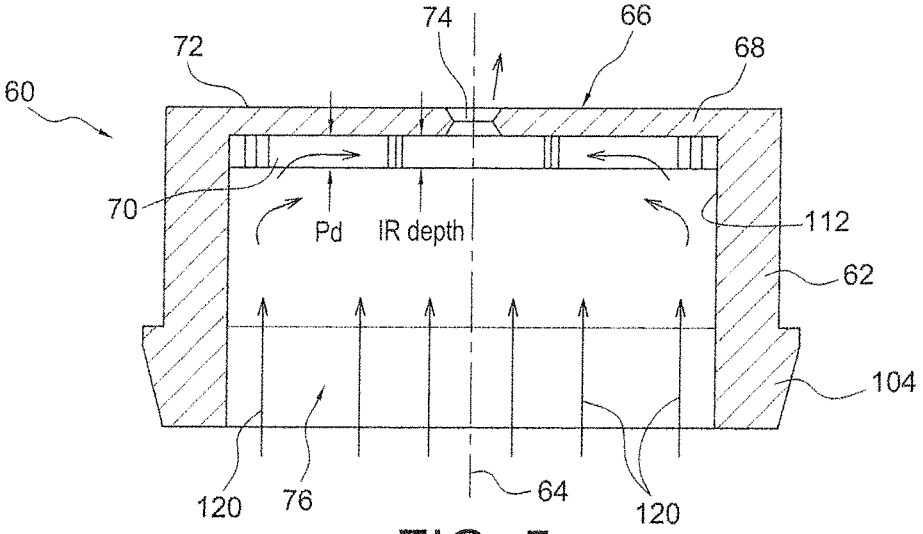
FIG. 5 is a cross-sectional view taken along line 5-5 of the HE-MBU nozzle embodiment of FIG. 4, taken generally along a longitudinal axis, and showing cross sections along a plane bisecting the HE-MBU nozzle.
Figure 6:
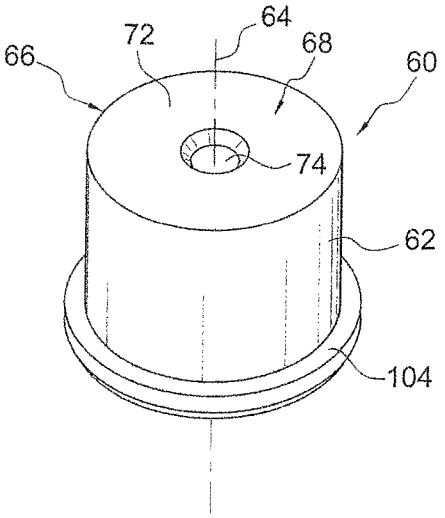
FIG. 6 is a top perspective view of the nozzle of FIGS. 4 and 5.

In the first form of the invention illustrated in FIG. 4, a cup-shaped High-Efficiency Mechanical Break-Up ("HE-MBU") nozzle member 60 formed of a molded plastic or other suitable material, has a body consisting of a cylindrical sidewall 62 surrounding a central axis 64, and a closed upper end generally indicated at 66 (as viewed in FIGS. 5 and 6). The closed end is formed by a substantially circular distal end wall 68 having an interior surface 70 and an exterior or distal surface 72. A central outlet channel or exit aperture or orifice 74 in the end wall provides fluid communication between the interior 76 of the cup, which receives fluid under pressure from a dispenser spray head, and the exterior of the cup from which the fluid spray is directed distally. Defined in the distal wall 68 at the interior surface 70 thereof is an enhanced swirl inducing mist generating structure consisting of first and second fluid speed increasing venturi power nozzles, or channels 80 and 82, each extending generally radially inwardly from the side wall 62 to a substantially circular central interaction chamber 84. The interaction chamber is formed in the bottom or inner transverse surface of wall 68 and defines a lumen which surrounds and is concentric to the exit aperture 74.

Figure 7:
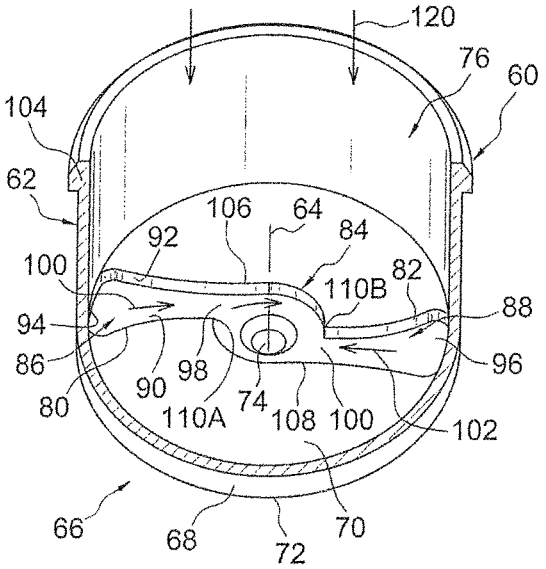
FIG. 7 is a perspective cut-away view of the interior of the nozzle of FIGS. 4 and 5.

As illustrated in the bottom plan view of FIG. 4 and in the inner perspective cut-away view of FIG. 7, wherein a portion of the side wall 62 has been removed, the power nozzles 80 and 82 formed in the top wall 68 are defined by respective tapering channels or lumens 86 and 88, respectively, having a continuous, substantially flat floor 90 formed in the wall 68 and a substantially perpendicular continuous sidewall 92 of a selected constant height Pd, which defines its depth in the wall 68. Similarly, the generally circular region of interaction chamber 84 is formed by a continuation of the lumen floor 90 and sidewall 92 and also has a depth Pd. Preferably, the sidewall 92 for the power nozzles 80 and 82 and the interaction chamber 84 is smoothly curved generally around and then generally radially inwardly from enlarged end regions 94 and 96 near the inner surface of nozzle wall 62 toward the chamber 84 to produce a narrowing flow path having a width Pw. The power nozzle chambers 80 and 82 taper inwardly toward respective narrow power nozzle outlet regions 98 and 100, the chambers extending along respective axes 102 and 104, respectively. The power nozzle outlet regions terminate at, and merge smoothly into, the interaction or swirl chamber 84.

Figure 8B:
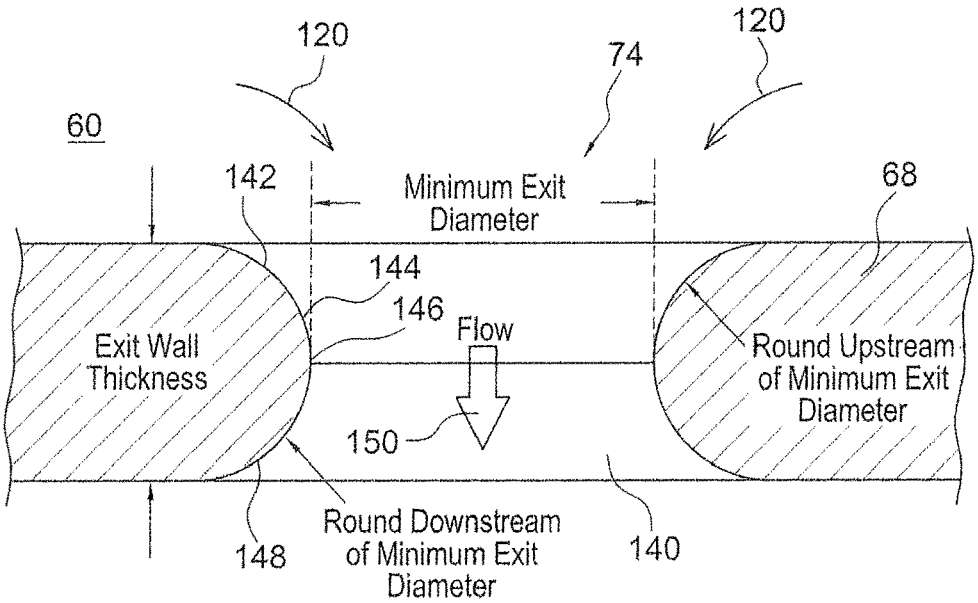
FIG. 8B is an enlarged detailed view of a portion of the exit aperture of the HE-MBU nozzle of FIGS. 4-8A, in accordance with the present invention.
Figure 8A:
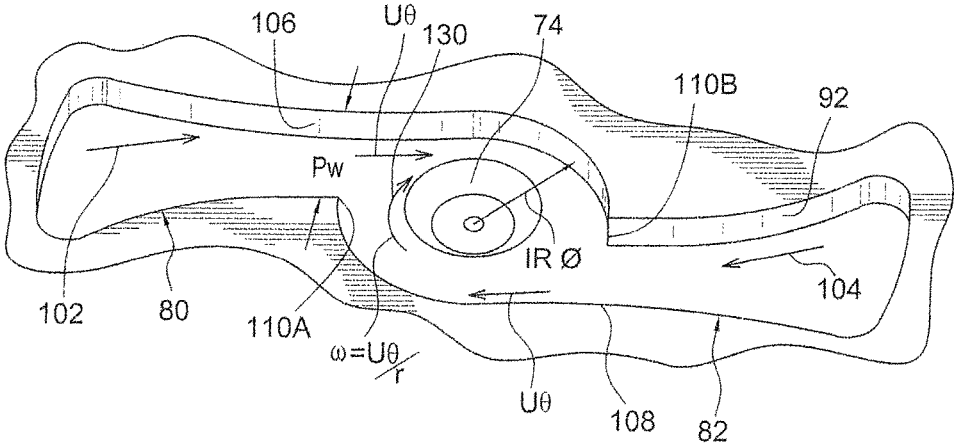
FIG. 8A is an enlarged partial view of the power nozzles and interaction chamber illustrated in FIG. 7.

Each of the power nozzle outlet regions has a relatively narrow selected power nozzle exit width $P_W$ at its intersection with the interaction chamber, with the generally radial axes of the power nozzles 80 and 82 being offset in the same direction from the central axis 64 of the nozzle 60. This offset causes the fluid flowing in the power nozzles to enter the interaction chamber 84 at desired angles, preferably substantially tangentially, to produce a swirl vortex in the interaction chamber which then flows out of the nozzle outlet 74 through the end wall 68. In the illustrations of FIGS. 4, 7 and 8A it will be seen that the power nozzles are each directed to the left of the axis 64 to produce a clockwise swirl, or fluid vortex, around the outlet 74. As illustrated at 106 and 108, in this embodiment the left sidewall of each power nozzle (viewed in the direction of flow) merges substantially tangentially with the interaction chamber sidewall to cause the desired swirl in the fluid flow from the nozzle; however, it will be understood that the angle of entry of air into the interaction chamber 84 may be at some other selected angle. Opposite the regions 106 and 108, the side wall 92 bends abruptly at the junctions of the power nozzles 80 and 82 with the interaction chamber, as illustrated at 110 and 112, to form a shoulder that causes fluid flow in the interaction chamber to continue its swirling motion to exit at outlet 74 instead of continuing past the outlet region and into the opposite power nozzle, contrary to the inlet flow direction. The smoothly curved sidewall 92 and narrowing lumens accelerate the velocity of the flowing fluid which causes enhanced mechanical breakup of the fluid into droplets as the swirling fluid passes into and through into the interaction chamber and develops increased rotational and around the central axis 64 while flowing out through outlet 74, thereby generating a fine mist of sprayed fluid product 152 (see FIG. 9) having the desired consistent droplet size.

In accordance with the preferred method of the present invention, each High Efficiency Mechanical Break Up ("HE-MBU") nozzle member (e.g., 60) includes an enhanced swirl inducing mist generating structure defined in a surface (e.g., 70) with first and second opposing, offset power nozzle channels (e.g., 86, 88) each having an outlet width ("$P_W$") which is preferably about one third of the swirl chamber or interaction region's diameter "IRd" (or twice the radius IRϕ, as best seen in FIGS. 4 and 8A). Applicants have found that a critical relationship among these dimensions can be defined as the offset ratio "OR" outlet width ("$P_W$") divided by the swirl chamber or interaction region's diameter ("IRd"), so this Offset Ratio "OR" equals Pw/IRd. Applicants' experiments and testing of prototypes that the optimal value of the offset ratio OR is 0.37 (having tested values ranging from 0.30 to 0.50). The optimal angle of attack for the fluid jets flowing from the power nozzle channels was found to be substantially tangent to the adjacent segment of circumferential wall of the interaction region (e.g., 106, 108), and the optimal depth (Pd and IRdepth) was found to be a depth which is as small as possible (as limited by the selected fluid product's boundary layer effects, when the depth are too small, the adverse boundary layer effects counteract the gains from reduced volume of the features). For example, at the scale of a particular commercial air care fluid product nozzle being developed and evaluated, applicants have selected a depth (Pd and IRdepth) of 0.20 mm. In the embodiment illustrated in FIGS. 4-8B), the swirl chamber depth (IRdepth) is the same depth as the depth of the power nozzles (Pd) to minimize volume.

Alternative embodiments are also contemplated. In the embodiment of FIGS. 4-8B), the power nozzle channel and swirl chamber depth are the same (as best seen in FIG. 5), meaning the power nozzles and swirl chambers are all configured as fluid channels having single selected depth (e.g., 0.20 mm). An alternative embodiment would include a varying depth, providing a tapered or converging floor of the channels in the enhanced swirl inducing mist generating structure. Instead of having a constant depth for the power nozzle chambers and the interaction region or swirl chamber, the depth of the power nozzles tapers from deeper to shallower at a selected taper angle (with the power nozzle channels being deeper at the power nozzle inlets and becoming shallower in the direction of flow) to provide another swirl inducing mist generating structure which is believed likely to further improve atomization efficiency.

Figure 9:
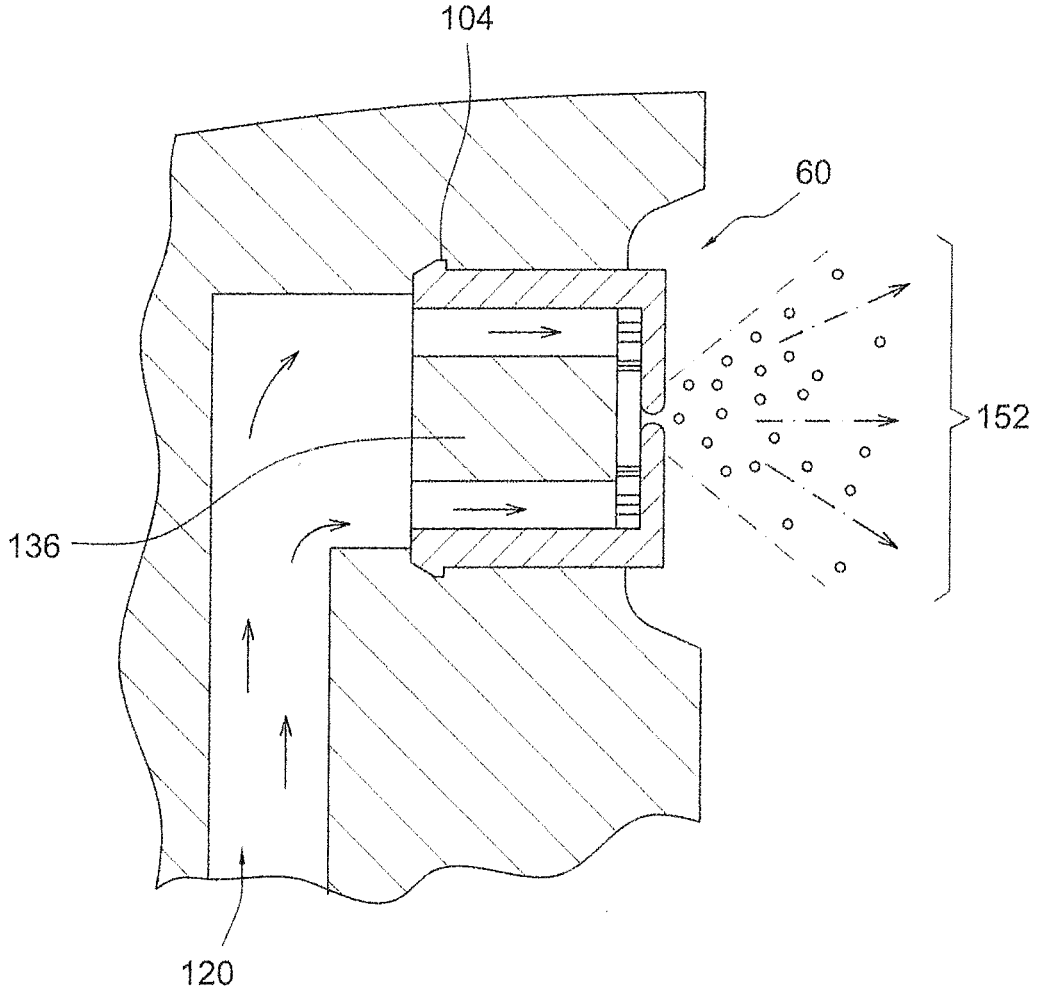
FIG. 9 is across sectional view of a nozzle assembly with the exit aperture of the HE-MBU nozzle cup of FIGS. 4-8B engaged against the sealing post, in accordance with the present invention.

Surrounding the bottom edge of the cup-shaped nozzle 60 is a flange 104 which provides a connection interface with a dispenser spray head in known manner, as by engaging a corresponding shoulder on the interior surface of the spray head outlet (as best seen in FIG. 9).

In operation, a pressurized inlet fluid or fluid product, indicated by arrows 120, flows from a suitable dispenser spray head into the interior 76 of the nozzle 60, toward and into the lumens of power nozzles 86 and 88 formed and defined in the interior surface of the distal wall 68. The pressurized inlet fluid flows distally along an annular channel defined by the interior surface 112 of the cylindrical sidewall 62 and around distally projecting sealing post 136 to enter the power nozzles 86, 88. Upon reaching the fluid impermeable barrier of distal end wall 68, the fluid 120 is forced into and through the enlarged inlet regions of power nozzle lumens 86 and 88 and is accelerated transversely and inwardly toward the central axis 64 of exit orifice aperture 74. The opposing transverse power nozzle flow axes 102 and 104 are offset with respect to the distal axis 64 of outlet 74, and are aimed slightly away from or offset with respect to each other, and the inward taper of the venturi-shaped lumens accelerates the fluid flowing along them toward the intersection of the power nozzle outlets 98 and 100 where the opposing flows are aimed into the interaction chamber 84 along power nozzle outlet flow axes 102, 104 as illustrated in FIGS. 4, 7, and 8A. The offset of flow axes 102, 104 causes the inrushing fluid to enter opposite sides of the interaction chamber 84 to introduce a swirling motion in the flowing fluid, forming a vortex indicated by arrow 130 in the fluid which flows out of the exit aperture or orifice 74 so that a fluid spray is directed along the central axis 64 out of the nozzle 60.

Figure 3:
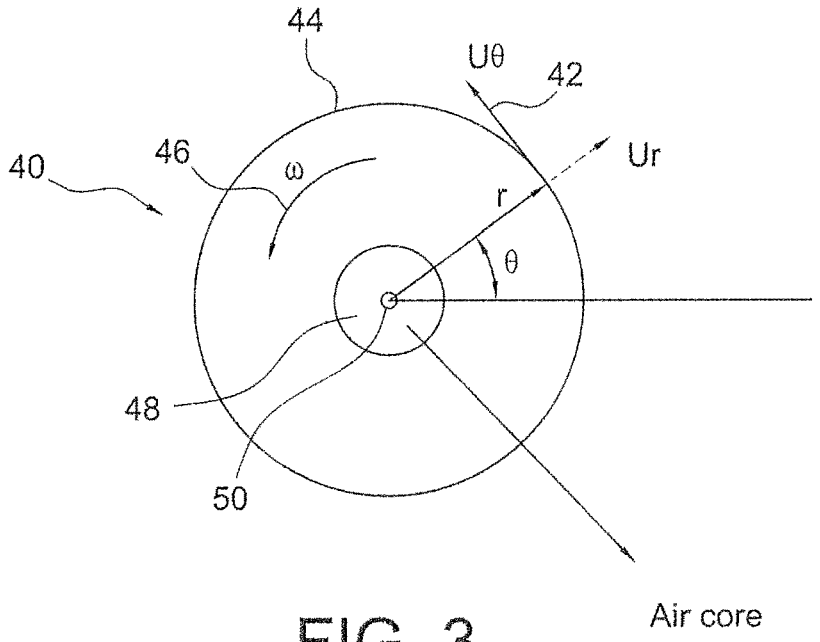
FIG. 3 is a diagram illustrating applicants' analysis of fluid flow patterns in a prior art swirl nozzle interaction region.

In operation, the swirl or interaction region (e.g., 84) is completely filled with a continuous, rotating mass of liquid, except at the very center (along the exit orifice axis 64, where centrifugal acceleration causes a negative pressure region open to the atmosphere. This region is referred to as the air core. The air core region (as shown in the center of FIG. 3) is axially aligned with the exit orifice. The fluid vortex formed in the interaction region has a large angular velocity, and as flow exits the nozzle's exit orifice, that liquid flow then proceeds to atomize, or break up into sprayed swirling fluid droplets with a specific radius r or droplet size distribution.

The device of this first embodiment thus consists of one or more input channels or power nozzles of a selected width and depth, configured to inject pressurized fluid either tangentially into an interaction region, or at another selected inflow angle relative to the walls of the interaction region. The interaction region is preferably circular with a diameter (IRd) which is in the range of 1.5 to 4 times the power nozzle outlet width $P_W$, and in the preferred embodiment, outlet width ("$P_W$") which is preferably about equal to between one third and 0.37 times the swirl chamber or interaction region's diameter (IRd). The interaction chamber preferably has the same depth as each power nozzle, and is arranged so that the fluid flows from the power nozzles and enters the interaction region with a higher tangential velocity Uθ than the fluid entering the nozzles, setting up or generating vortex with radius r and a higher angular velocity $\omega = U\theta/r$. The rapidly spinning or swirling vortex then issues from interaction region through the exit aperture 74 which is aligned with the central axis 64 of the nozzle cup member 60. This configuration causes swirling fluid droplets that are generated in the swirl chamber to accelerate into a highly rotational flow which issues from the exit as very small droplets which are prevented from coagulating or recombining into larger droplets when sprayed distally in fluid product spray 152.

Applicant's preliminary development work included experimental findings which were initially thought to show that a critical design parameter was the power nozzle aperture Aspect Ratio (defined as the Power Nozzle Depth divided by the Power Nozzle Width (AR=Pd/Pw)). A gain in angular velocity ω was initially attributed to the velocity profile of fluid flow exiting the power nozzle. Typical prior art swirl nozzles exhibit an AR ranging from 1.0 to 3.0, while an early and promising prototype of the improved swirl cup ("HE-MBU") device of the present invention had an AR≤1.0. The Aspect Ratio (or cross section Depth over Width) was later discovered to be less critical than initially believed, and the significantly improved performance of the nozzles of the present invention was instead optimized by optimizing the offset ratio "OR" as described above (Pw/IRd).

Another critical part of creating and maintaining sprays of fine droplets is the geometry of the swirl or interaction region's exit orifice. The exit orifice or aperture 74 of the nozzle 60 of the present invention incorporates an outlet or exit geometry (as illustrated in the enlarged view of FIG. 8B) which is optimally configured in distal end wall 68 to minimize fluid shear losses and maximize the spray cone angle (e.g., for fluid product spray 152). The geometry can be characterized as a non-cylindrical exit channel 140 having a substantially circular cross-section and defined in three axially aligned features, labeled in the Figure as:

(1) a proximal converging entry segment 142 which has a continuous rounded or radiussed shoulder surface of gradually decreasing inside diameter (from the interior wall of the nozzle member);

(2) a rounded central channel segment 144 which is distal or downstream of the converging entry segment 142 and defines a minimum exit diameter segment 146 with substantially no cylindrical "land" (or cylindrical interior surface of constant inside diameter); and (3) a distal diverging exit segment 148 which has a continuous rounded shoulder or flared horn-like interior surface of gradually increasing inside diameter downstream of the minimum exit diameter segment 146.

Fluid 120 entering the nozzle member 60 and flowing through the power nozzles 80 and 82 into the interaction chamber 84 generate the swirling pattern, or vortex, which flows into entry segment 142, through the minimum diameter segment 146 and out of the exit segment 148 to the atmosphere, as indicated by flow arrow 150. Features (1) & (2) reduce shear losses and retain the maximized angular velocity ω of the swirling distally projecting droplets. Feature (3) allows maximum expansion of a spray cone forming downstream of the minimum exit diameter and minimizes the recombination of the droplets in the distally projecting spray. Sprayed droplets are also referred to as particles, for fluid product spray droplet size determination purposes. For many product sprayer applications, it is preferred that the Volumetric Median Diameter ("VMD" or "DV50") and domain of the droplet size distribution be as small as possible (meaning, small, uniform mist-like droplets are desired). The flared or diverging shape of Feature (3) prevents VMD losses due to coagulation by maximizing the spray cone angle for a given spray's rotating or angular velocity ω.

The reduced shear losses and larger rotating or angular velocity ω combined with reduction in coagulation results in the spray output exhibiting improved atomization. The VMD of the spray droplet distribution is reduced (i.e., has a droplet diameter of 60 μM or less) for a typical pressure and generates smaller and more uniform droplets than prior art swirl cups at any given pressure. The nozzle 60 of the present invention as illustrated in FIGS. 4-9 produces a desired VMD or DV50 at a lower operating pressure than an ordinary or prior art swirl cup (e.g., as used in the prior art nozzles of FIGS. 1A-2B).

The many design iterations of the nozzle structure described above permitted applicants to evaluate the most effective design parameters which may be exploited for optimizing angular velocity ω. As noted above, an enhanced understanding of observed gains in rotating or angular velocity ω was found after the above defined "offset ratio" (the ratio of the width of the power nozzle with respect to the diameter of the interaction region) was discovered. As noted above, Prototypes with offset ratios ranging from 0.30 to 0.50 have been tested, and sprayed fluid atomization efficiency was observed to increase as this ratio approaches what was discovered to be an optimum value of 0.37. By substituting the offset ratio for the above-described power nozzle aspect ratio in designing a nozzle configuration in accordance with the present invention, the swirl nozzle geometry can be analyzed in only two dimensions. Particle tracking velocimetry performed with scaled up Plexiglas prototypes and a high speed camera helped applicants to visualize the velocity profile of the swirling fluid of the exit spray (not shown). The offset ratio defines the position and size of the power nozzles relative to the interaction region, and was found to be the dominant variable in controlling the velocity profile of the fluid and maximizing atomization efficiency. The optimum velocity profile through the power nozzle conserves initial kinetic energy and allows for the greatest acceleration of fluid entering the interaction region, generating highest values of rotating or angular velocity ω.

The depth "Pd" of the fluidic circuit of the nozzle, which includes the power nozzle and interaction chambers (80, 82 and 84 in FIG. 4), also affects the atomization efficiency of the nozzle. As the depth is reduced, the volume of the interaction region is reduced. It has been observed that as the depth increases, more kinetic energy is required to generate equivalent w relative to a shallower swirl chamber. Hence, as the depth increases, atomization efficiency is reduced. This is why the preferred embodiment of the invention exhibits a depth d in the in the interaction chamber=Pd, the depth of the power nozzles (see FIG. 4), as the minimum depth. Experimental data indicates that circuit depth can be reduced as low as 0.20 mm before the boundary layer effects described above start to cause losses in atomization efficiency.

A second design iteration includes the design of the exit orifice profile described above with respect to FIG. 8B. This improvement specifically relates to injection molding cost & feasibility. The initial development work illustrated in the embodiment of FIGS. 4-8B was based on the design conclusion that there should be a minimum area of circular cross section 146, normal to the axis of flow 150, which has a lead-in radii or rounded shoulder 142 on the upstream edge and a rounded shoulder 148 on the downstream edge of exit orifice 74. In another embodiment of the invention, it was found that equivalent atomization performance was realized with only the lead-in radius 142 on the upstream edge of the exit orifice. By removing the downstream radius 148, and leaving a sharp edge (see, e.g., 290 as illustrated in FIG. 12), the "shut off" of the two halves of an injection molding tool (not shown) changes location, and becomes significantly more robust.

The tooling is more robust in terms of A & B side alignment, and tool wear & required maintenance. In the previous configuration, any misalignment between the two halves of the tool would result in a step at the minimum cross sectional area location (e.g., 146) of the exit orifice. This could potentially change that critical area, or even worse, increase shear losses in flow 150 due to wall friction. Any imperfections in the exit orifice profile (e.g., as seen in FIG. 8B) are likely to neutralize any gains in atomization. Also, the diameter of the B side orifice pin of the molding tool (not shown) at the shut off location increases by an order of magnitude, and is subject to substantially less wear and maintenance than the original 0.300 mm pin used for the prior tooling. While exit orifices with downstream radii have been observed to generate greater atomization efficiency than those without downstream radii, significant performance gains require very large cone angles <100° and are not practical for consumer spray applications.

FIG. 9 illustrates a nozzle assembly with the improved High-Efficiency Mechanical Break-Up ("HE-MBU") swirl cup nozzle 60 installed upon and in coaxial sealing engagement with a distally projecting seal post 136 (which is similar to standard seal post 36 shown in FIG. 2A). When in use, the fluid product 120 flows into the nozzle assembly and into the annular lumen defined around the distally projecting seal post 136, flowing distally and into the fluid speed increasing venturi power nozzles, or channels 80 and 82 of nozzle member 60.

Figure 10:
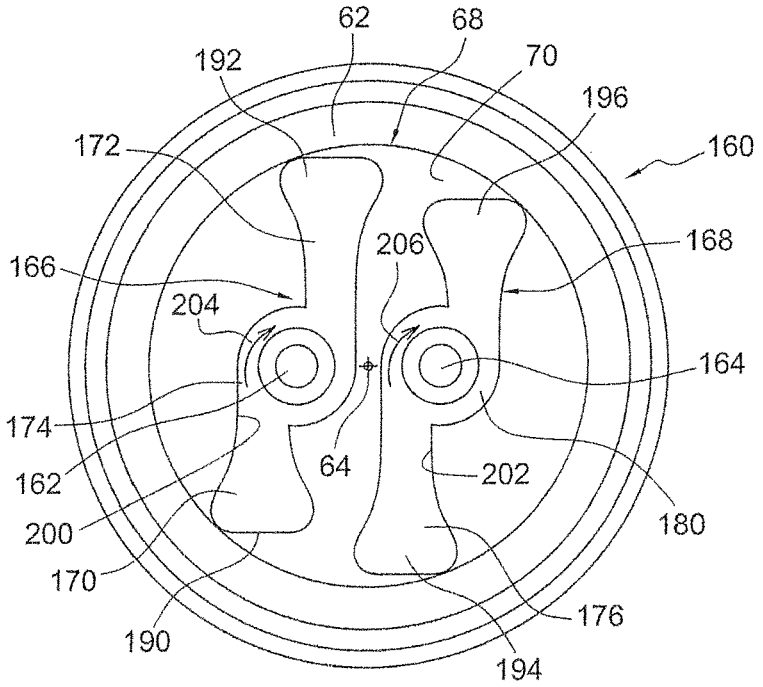
FIG. 10 is a top plan view of a second embodiment of a High-Efficiency Mechanical Break-Up ("HE-MBU") nozzle in accordance with the present invention, illustrating multiple nozzle exits having equal rotation orientations.
Figure 11:
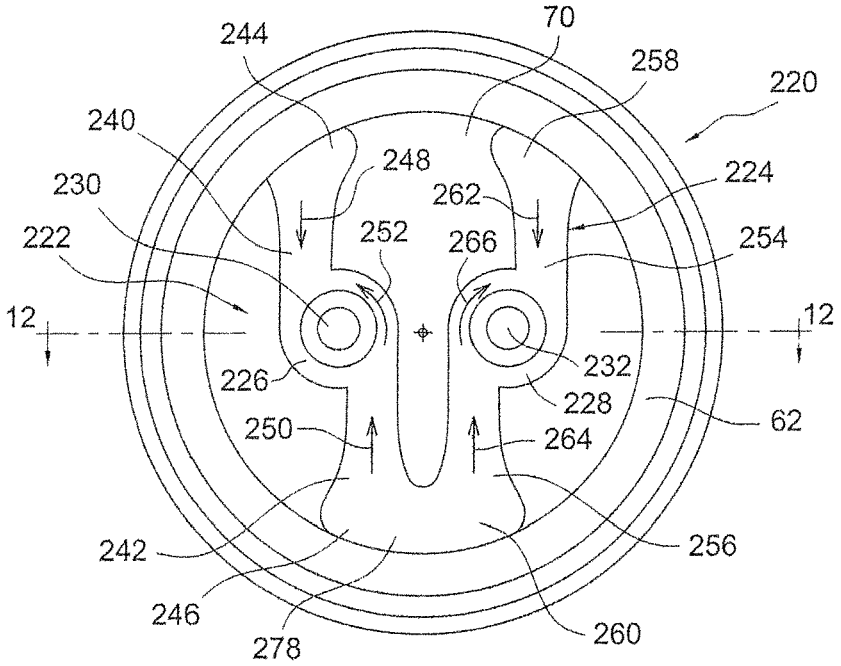
FIG. 11 is a top plan view of a third embodiment of the High-Efficiency Mechanical Break-Up ("HE-MBU") of the present invention, illustrating a nozzle assembly configured with first and second nozzle exits generating first and second sprays with opposing rotational orientation.
Figure 12:
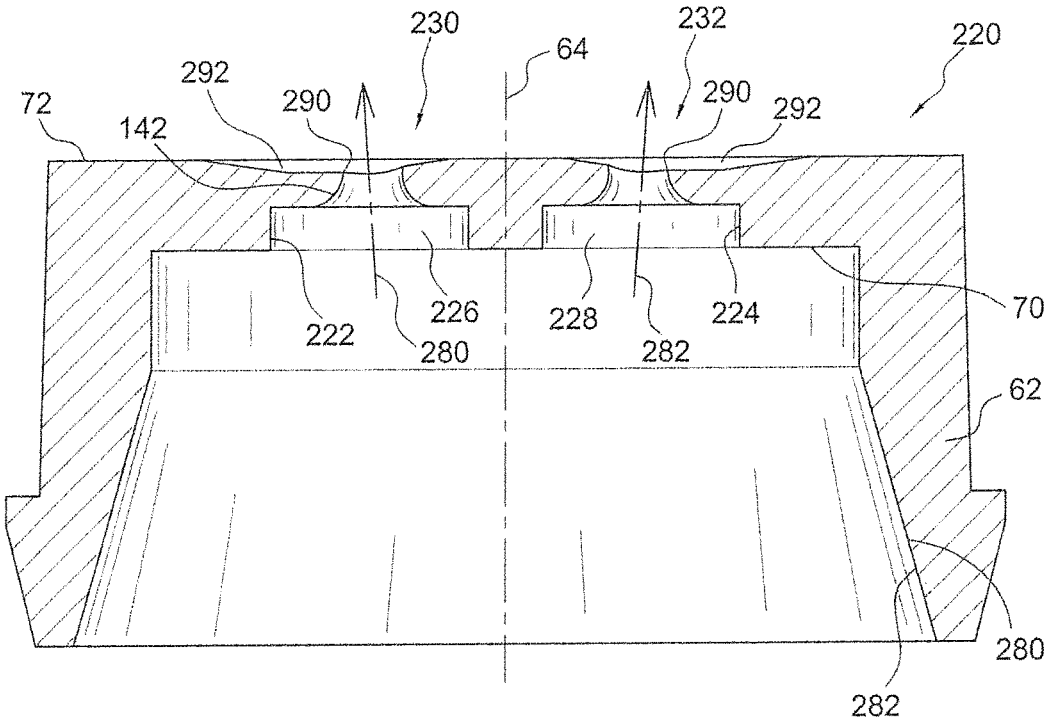
FIG. 12 is a cross-sectional view illustrating another HE-MBU nozzle embodiment similar to that of FIG. 11, taken generally along a longitudinal axis, and showing cross sections along a plane 11-11 of FIG. 11, bisecting the HE-MBU nozzle to show that the exit orifices of the FIG. 11 embodiment may configured with diverging throats to aim the sprays away from one another.

A third iteration of the design parameters is illustrated in the embodiments of FIGS. 10-12, which were developed for applications that demand larger flow rates than the 30-40 mLPM @40 psi of the original nozzle 60 described above. Obtaining a greater fluid flow is particularly challenging due to the clear correlation between droplet size and flow rate. As flow rate increases, droplet size increases. The unique value of the high flow embodiments of the present invention is that nearly twice the flow rate of the original nozzle 60 can be obtained without sacrificing atomization performance. This novel improvement was attained by scaling down the swirl nozzle geometry slightly, and then packaging two separate enhanced swirl inducing mist generating structures into one cup-shaped insert, as illustrated in FIGS. 10 and 11-12. The preferred "high flow" embodiments are designed to function with a sealing post (e.g. 136) having a diameter 2.50 mm, and the illustrated high flow embodiments exhibit an average flow rate 70 mLPM @ 40 psi and an average DV50=60 μm @140 psi.

The second embodiment of the High-Efficiency Mechanical Break-Up ("HE-MBU") nozzle of the invention is illustrated at 160 in FIG. 10, which is a bottom plan view of a cup-shaped nozzle having a pair of exit apertures, or orifices 162 and 164 and incorporating first and second HEMBU circuits 166 and 168, oriented to produce equal rotation. As illustrated in the first embodiment, the HE-MBU nozzle assembly 160 is configured as a cup-shaped solid having a cylindrical sidewall 62 defined around a distally projecting central axis 64 terminating in a distal end wall 68 having an interior surface 70 and an exterior or distal surface 72 (not shown in FIG. 10). In the illustrated embodiment, distal end wall 68 has first and second outlet channel or exit orifices 162 and 164, each providing fluid communication between the interior and exterior of the cup.

On the interior of the cup member, defined in the substantially circular interior surface 70 of distal wall 68 are the power nozzle circuit 162 incorporating power nozzle chambers 170 and 172 providing fluid communication to and terminating in an interaction or swirl vortex generating chamber 174 and the second power nozzle circuit 168, incorporating power nozzle chambers 176 and 178 providing fluid communication to and terminating in an interaction or swirl vortex generating chamber 180. The power nozzles 166 and 168 are both similar to the nozzle circuit described with respect to FIGS. 4-9, with each power nozzle chamber defining a tapering channel of selected constant depth Pd and narrowing width Pw which terminates in a power nozzle outlet or opening having a selected power nozzle width ($P_W$) at its intersection with its corresponding interaction chamber.

First and second laterally spaced enhanced swirl inducing mist generating structures 166 and 168 are disposed equidistantly on opposite sides of the nozzle member's central axis 64 and are generally parallel to each other, and are formed in the inner surface 70 of the end wall 68 to have their inlet ends 190, 192 for enhanced swirl inducing mist generating structure 166, and 194, 196 for enhanced swirl inducing mist generating structure 168 formed in the interior surface 70 of distal wall 68 proximate the cylindrical sidewall 62. Pressurized inlet fluid flows distally into the interior of the cup and along sidewall 62 to enter the inlet ends and flows inwardly along each power nozzle to enter the respective interaction chambers. As described above, the power nozzles incorporate continuous vertical sidewalls 200 and 202 which define tapered fluid speed increasing venturi power nozzles or lumens which cause the fluid to accelerate along the power nozzles flow path.

As seen in FIG. 10, each interaction or swirl region 174 and 180 is defined between its respective power nozzles as a chamber of substantially circular configuration, having cylindrical sidewalls (formed by continuations of sidewalls 200 and 202). The interaction regions are equally spaced on opposite sides of, and are parallel to, the distally projecting central axis 64 of distal end wall 68 and are coaxially aligned with their respective outlet channels or exits 162 and 164. It is noted that the axes of the power nozzles are offset with respect to their interaction regions to produce a clockwise swirling motion in the fluid in both regions, as indicated by arrows 204 and 206. This structure provides fluid communication between each interaction chamber and the exterior of the cup so that spray is directed out of the nozzle 160 in similar vortexes along two parallel axes spaced from but parallel to the cup's central axis 64.

The spray issuing from the left outlet 162 has a clockwise rotational orientation 204 and a rotational velocity defined by the geometry of power nozzles 190 and 192. The spray issuing from right outlet 164 also has a clockwise rotational orientation 206 and a rotational velocity defined by the geometry of power nozzles 194 and 196. The High-Efficiency Mechanical Break-Up ("HE-MBU") nozzle member 160 is thus configured to generate first and second fluid product sprays aimed along first and second spaced-apart spray axes, where each spray has a rotational orientation and a rotational velocity, thereby generating a combined spray pattern. In the embodiment illustrated in FIG. 10, the High-Efficiency Mechanical Break-Up ("HE-MBU") nozzle member 160 generates laterally spaced simultaneous sprays of distally projecting fluid product droplets having substantially equal rotational orientations and substantially identical rotational velocities.

FIGS. 11 and 12 illustrate a third embodiment of the present invention wherein an opposing rotation HE-MBU nozzle member 220 is also configured as a cup-shaped solid, as illustrated in the above-described embodiments, wherein similar features are similarly numbered. In this embodiment, a cylindrical sidewall 62 surrounds a distally projecting central axis 64 and terminates in a distal end wall 68 having a circular interior surface 70 and an exterior or distal surface 72. In the illustrated embodiment, distal end wall 68 has first and second outlet channel or exit orifices 230 and 232, each providing fluid communication between the interior and exterior of the cup.

Formed in the interior surface 70 of nozzle 220 are first and second HE-MBU enhanced swirl inducing mist generating structure 222 and 224 incorporating respective interaction regions 226 and 228 surrounding their respective orifices 230 and 232. The first or left enhanced swirl inducing mist generating structure 222 incorporates a pair of power nozzle channels 240 and 242 extending inwardly from enlarged regions 244 and 246 at the side wall 62 and tapering inwardly to merge with diametrically opposite sides of the first or left interactive region 226. The axes 248 and 250 of these channels are offset with respect to the corresponding interaction region 226 to produce a swirling fluid flow in region 226; in the illustrated embodiment of FIG. 11 each power nozzle flow is offset to the right side of the exit orifice 230 to produce a counter-clockwise flow 252. This may be contrasted with the second enhanced swirl inducing mist generating structure 224 which incorporates a pair of power nozzle channels 254 and 256 extending inwardly from enlarged regions 258 and 260 at the side wall 62 and tapering inwardly to merge with diametrically opposite sides of second interactive region 228. The offset axes 262 and 264 of these channels are offset with respect to their corresponding interaction region 228 to produce a swirling fluid flow in region 228; in the illustrated case each offset is to the left side of the exit orifice 232 to produce a clockwise flow 266. The opposite offsets with respect to the corresponding exit orifices 230 and 232 produce opposite rotational flows from the two outlet orifices.

The spray issuing from the left outlet 222 thus has the counter-clockwise rotational orientation 252 and a rotational velocity defined by the geometry of power nozzles 240 and 242. The spray issuing from right outlet 232 has an opposite, clockwise rotational orientation 266 and a rotational velocity defined by the geometry of power nozzles 264 and 266. The High-Efficiency Mechanical Break-Up ("HE-MBU") nozzle member 220 is thus configured to generate first and second fluid product sprays aimed along first and second spaced-apart, diverging spray axes, where each spray has a selected rotational orientation and a rotational velocity, thereby generating a combined spray pattern. In the embodiment illustrated in FIGS. 11 and 12, the High-Efficiency Mechanical Break-Up ("HEMBU") nozzle member 220 generates laterally spaced, diverging simultaneous sprays of distally projecting fluid product droplets having opposing rotational orientations and substantially identical rotational velocities. The applicants have observed that for certain fluid product spraying applications, marginally better spray generating performance has been observed from multi-outlet spray devices having such output sprays, with opposite rotational orientations (as compared to multi-outlet spray devices having the same rotational orientation such as is provided in the structure of FIG. 10). This is likely due to the fact that in the third, and preferred, configuration of FIGS. 11 and 12, the two generated fluid sprays or cones intersect each other with tangential velocity vectors adjacent the nozzle axis 64 facing the same direction (not shown, but "up" for the embodiment of FIG. 11), whereas in the embodiment illustrated in FIG. 10, the tangential velocities of the first and second sprays or cones at their closest point of intersection in the region of the axis 64 are opposite one another. It is believed that this opposite flow results in more energy loss where the spray cones intersect and results in coagulation of droplets downstream.

In the embodiment of FIGS. 11 and 12, each power nozzle defines a tapering channel of selected constant depth but narrowing width as previously described with respect to prior embodiments, with each channel terminating in a power nozzle outlet or opening having a selected power nozzle width ($P_W$) at respective interaction chambers 226 and 228. As previously noted, each power nozzle chamber has an inlet region 244, 246 and 258, 260 which is defined in the interior surface 70 of distal wall 68 proximate the cylindrical sidewall 62. As illustrated in FIG. 12, the interior surface 280 of side wall 62 is tapered inwardly from a nozzle inlet 282 which receives fluid from a dispenser such as that illustrated in FIG. 1 to the inner surface 70 of the end wall 68. Pressurized fluid flowing distally along the interior surface of the cup and along sidewall 282 enters the inlet of each power nozzle channel and accelerates inwardly along the tapered lumens of the channels to enter the interaction chambers 226 and 228.

For the multi-spray embodiments of FIGS. 10 11 and 12, each of the interaction or swirl regions is defined between its opposing, offset power nozzles as a chamber of substantially circular section having cylindrical sidewalls parallel to the cup member's distally projecting central axis 64 and each interaction or swirl region is coaxially aligned with its respective outlet channel or exit orifice to provide fluid communication between that interaction chamber and the exterior of the cup so that the fluid product spray is directed along an axis which is spaced from but parallel to the cup's central axis 64 (sprays not shown). As illustrated in the embodiment of FIG. 11, the enhanced swirl inducing mist generating structures 222 and 224 are illustrated as being slightly divergent across the width of the cup portion of the nozzle so that the enlarged channel ends 246 and 260 merge, as at 278 at the side wall 62. Slight modifications of the positioning of the swirl inducing mist generating structures may be made, as long as they do not interfere with essential functions of the fluid channels.

FIG. 12 illustrates an embodiment of nozzle member 220 which has exit orifices 230 and 232 which are modified from those of FIG. 11 to be non-parallel or diverging, as illustrated by orifice axes 280 and 282 which diverge from nozzle axis 64. The diverging exit orifices provide a spray aiming feature designed to reduce the region in which the two spray cones intersect (not shown), as well as to discourage downstream droplets from coagulating. While testing of the HE-MBU nozzle member 220 of FIG. 12, it was discovered that the region of spray intersection was successfully reduced, no significant improvements to atomization performance were observed. This is attributed to frictional losses associated with increased throat lengths.

The diverging spray HE-MBU nozzle member 220 incorporates interaction or swirl regions 226 and 228, as described above, which are defined between their respective power nozzles as being chambers of substantially circular section having cylindrical sidewalls aligned along the same distally projecting central axis 64 in the distal end wall 68 and aligned with and surrounding respective outlet channel or exit orifices to provide fluid communication between that interaction chamber and the exterior of the cup so that the distally projecting simultaneous fluid product sprays (not shown) are directed along angled spray axes which are spaced from but not parallel to the cup's central axis.

The embodiment of FIG. 12 incorporates the design of the exit orifice profile described above which specifically relates to lower injection molding cost and improved feasibility. As described, the embodiments of FIGS. 4-9 were based on the conclusion that there should be a minimum area of circular cross section (146 in FIG. 8A) normal to the axis of flow exiting the nozzle, which, as illustrated in FIG. 8A, has a lead-in radius or rounded shoulder 142 on the upstream edge and a rounded exit shoulder 148 on the downstream edge of exit orifice 74. As illustrated in FIG. 12, each of the exit orifices 230 and 232 incorporates only the lead in radius 142 on the upstream (interior) edge of that orifice. By removing the downstream radius 148 to produce a sharp downstream orifice edge 290 (with no cylindrical or flat sidewall segment), the shut off of the two halves of an injection molding tool (not shown) changes location, and becomes significantly more robust. This sharp edge can be produced by forming a shallow depression, such as that illustrated at 292, surrounding each exit orifice.

The principle of improved atomization at higher flows can be extended to multiple swirl geometries. In the exemplary embodiments of FIGS. 10-12 there are two swirl chambers, but this method for simultaneously generating plural sprays can be easily extended to up to a larger number (e.g., ten) swirl chambers if required, depending on packaging space and product spray requirements.

Figures 13A, 13B:
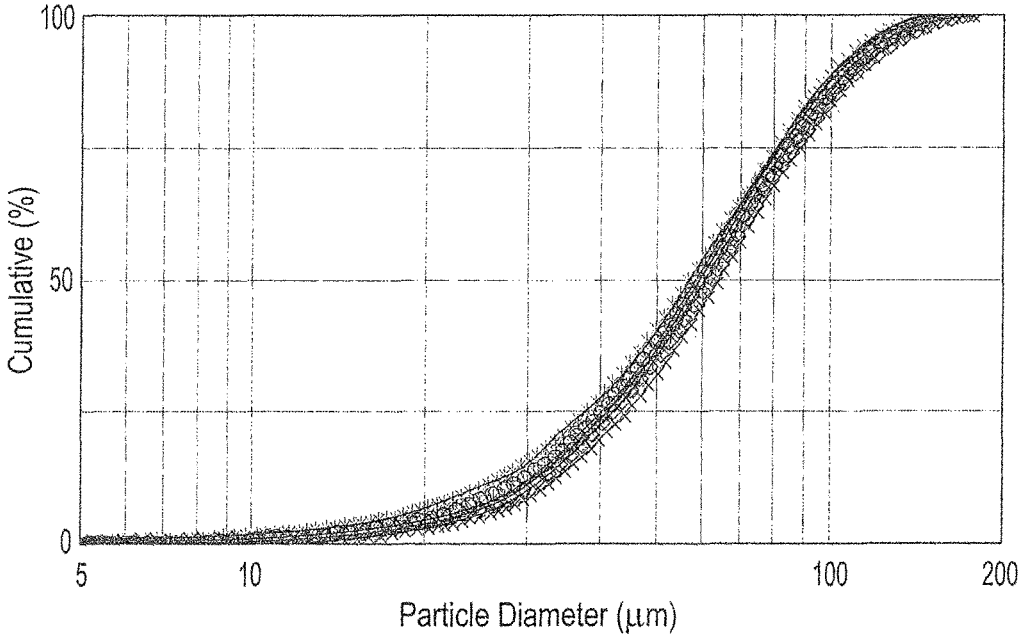
FIGS. 13 and 14 illustrate in graphic and tabular form measured spray droplet generation performance for the uniform particle diameter generating HE-MBU nozzles of the present invention.
Figures 14A, 14B:
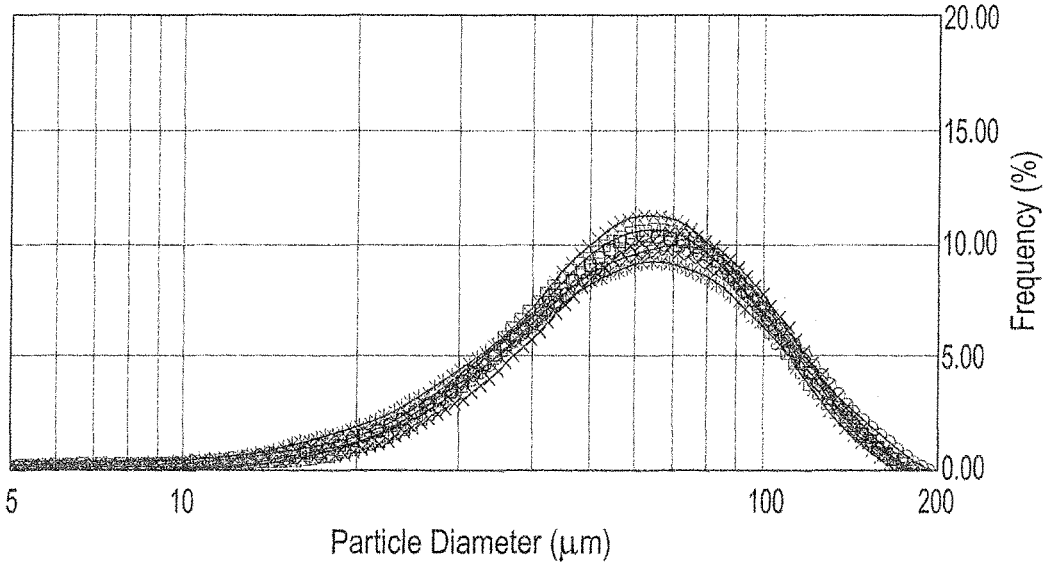

The performance of the nozzle assemblies of the present invention has been measured for uniformity of diameter of generated particles, and the results of such measurements are illustrated in FIGS. 13A-14B. Measurements of the spray generated with HE-MBU nozzle 220 show generation and maintenance of mist sprays with very high rotating velocity and very little recombination of the mist drops, even when measured at 9 inches from the nozzle exit aperture(s) (e.g., 230, 232). The plots and Tables of FIGS. 13A-14B illustrate the performance gains made available by the nozzle assemblies incorporating the improved swirl cup members of the present invention. The exit geometry lumen of the present invention (e.g., 74 in FIG. 8A or 230 and 232 in FIG. 12)) preserves the rotational energy of the small droplets created in the interaction chamber and also conserves the small droplet size. To demonstrate the value of the HE-MBU nozzle, an experiment was performed to characterize its droplet size distribution. The nozzle configuration selected was two swirl circuits with opposite rotational orientation, (e.g., 220, as illustrated in FIG. 11). Ten duplicate prototypes were CNC machined & tested with an off the shelf can of compressed gas air freshener, with an average starting pressure of 140 psi. These measurements were recorded with a Malvern™ Spraytec™ system, which uses industry standard methods of laser diffraction to estimate particle size distributions. All tests were conducted with the spray nozzle 220 9" from the laser axis, with the distally projecting spray oriented horizontally. The plots of FIGS. 13 and 14 illustrate the output of these Spraytec measurements. FIG. 13 is a cumulative particle size distribution overlay of all ten samples. The Y axis is % of the spray, and the X axis is particle size diameter on a logarithmic scale. It is evident from this plot that the majority of particles measured exhibit a diameter ranging from 5 to 200 urn. One may infer the volumetric median diameter (Dv50) by determining the X location of the intersection of the plotted curves and the horizontal asymptote @ 50%. This estimate is confirmed in the data table at the bottom of the figure. In this table the individual prototype performance is summarized, and is centered about the Dv50 with average value of 60 urn.

FIGS. 14A and B illustrate the same data as FIGS. 13A and 13B in a different format. Instead of a cumulative representation of the spray percentage, the applicant estimated a % frequency. In other words, a certain particle diameter X was measured Y (N/N total particles measured) % of the time. The plotted measurement data illustrates that the Dv50 (particle size measured most frequently) represents approximately 10% of all particle sizes recorded. The range of particle sizes contained in the distribution is referred to as 'span'. To improve consistency of nozzle performance, it is desirable to reduce the span. The smaller the span of the distribution (195 um in this case), the sharper the peak in the frequency distribution plot.

The nozzles of the present invention can be configured for use with product packages for dispensing a wide variety of products including aerosols using Bag On Valve (BOV) and compressed gas methods to develop higher operating pressures (50-140 psi) rather than costly and less environmentally friendly propellants. The product packages using the above-described nozzle configurations are readily configured for higher operating pressures and can reliably produce a "mist spray" comprised almost entirely of product droplets having a desired small diameter (e.g., 60-80 μM or less, but larger than 10 μM).

Having described preferred embodiments of new and improved nozzle configurations and methods for generating and projecting small droplets in a mist, it is believed that other modifications, variations and changes will be suggested to those skilled in the art in view of the teachings set forth herein. It is therefore to be understood that all such variations, modifications and changes are believed to fall within the scope of the present invention.

What is claimed is:

1. A spray nozzle configured to generate a swirled spray with improved rotating or angular velocity ω, resulting in smaller and more uniform sprayed droplet size, comprising:

a cup-shaped nozzle body having a side wall surrounding a first central longitudinal spray axis and a closed end wall;

at least a first exit orifice passing through said end wall, said first exit orifice being coaxially aligned with said first central longitudinal spray axis;

a first enhanced swirl inducing mist generating structure in an inner surface of said end wall, said first enhanced swirl inducing mist generating structure including a first inwardly tapered power nozzle lumen directing fluid flow into and terminating in a first high efficiency mechanical break up interaction region which provides fluid communication with a said first exit orifice, said first power nozzle lumen directing fluid flow along a first power nozzle fluid flow axis that is substantially transverse to said first central longitudinal spray axis;

said first enhanced swirl inducing mist generating structure also including a second inwardly tapered power nozzle lumen directing fluid flow into and terminating in said high efficiency mechanical break up interaction region, said second power nozzle lumen directing fluid flow along a second power nozzle fluid flow axis which opposes and is offset from said first power nozzle's fluid flow axis;

wherein said first and second power nozzle lumens and said first interaction region have a substantially constant depth Pd from said power nozzle inlet and through their intersection with said first interaction region;

wherein said first exit orifice is defined in an interior surface of said end wall with a proximal converging entry segment including a continuous shoulder of gradually decreasing inside diameter and a rounded central channel segment downstream of said proximal converging entry segment which defines the minimum inside diameter of said first exit orifice passing through said end wall;

said first and second power nozzle lumens defining first and second opposing flow axes each being transverse to and offset with respect to said first central longitudinal spray axis, whereby fluid under pressure introduced into said first enhanced swirl inducing mist generating structure flows along said first and second power nozzle lumens into said interaction region to generate a swirling fluid vortex which breaks up the fluid into droplets of a selected droplet size and accelerates said fluid droplets to a selected angular velocity, wherein said fluid droplets are distally projected from said exit orifice as a swirled spray of fluid product droplets retaining said selected droplet size and having said selected angular velocity.

2. The spray nozzle of claim 1, wherein each power nozzle lumen tapers smoothly inwardly from an enlarged inlet region toward the first interaction region to accelerate fluid flow along a selected power nozzle lumen flow axis.

3. The spray nozzle of claim 2, wherein said first and second power nozzle chambers and said first interaction region have a selected depth and wherein said power nozzle chambers each have a minimum width Pw at their intersection with said first interaction region.

4. The spray nozzle of claim 3, wherein said first and second power nozzle lumens and first said interaction region have a substantially constant depth Pd from said power nozzle inlet and through their intersection with said first interaction region; said depth being at least 0.20 mm.

5. The spray nozzle of claim 3, wherein said first and second power nozzle lumens and said interaction region of said at least first enhanced swirl inducing mist generating structure are defined by a continuous wall substantially perpendicular to said end wall.

6. The spray nozzle of claim 2, wherein said first and second power nozzle lumens and said first interaction region are configured with a selected depth Pd and wherein said first and second power nozzle lumens each have a minimum width Pw at their intersection with said first interaction region;

wherein the interaction region is substantially circular with an interaction region diameter IRd which is in the range of 1.5 to 4 times the power nozzle outlet width Pw, whereby said fluid under pressure flows from the power nozzle lumens and enters the interaction region with a higher tangential velocity ue than the fluid entering the nozzle, setting up a fluid mist vortex comprising mostly fluid droplets with radius r and a higher angular velocity $\omega = \upsilon\theta/r$.

7. The spray nozzle of claim 2, wherein said first and second power nozzle lumens and said first interaction region are configured with a selected depth Pd and wherein said first and second power nozzle lumens each have a minimum width Pw at their intersection with said first interaction region;

wherein the interaction region is substantially circular with an interaction region diameter IRd which is used to define an Offset Ratio of Pw/IRd, and wherein said Offset Ratio is in the range of 0.30 to 0.50;

whereby said fluid under pressure flows from the first and second power nozzle lumens and enters the first interaction region with a higher tangential velocity $\upsilon\theta$ than the fluid entering the nozzle, setting up a fluid mist vortex comprising mostly fluid droplets with radius r and a higher angular velocity $\omega=\upsilon\theta/r$.

8. The spray nozzle of claim 7, wherein said Offset Ratio is 0.37.

9. The spray nozzle of claim 1, wherein said first interaction region is generally circular and coaxial with said first exit orifice passing through said end wall.

10. The spray nozzle of claim 1, wherein said nozzle incorporates a single enhanced swirl inducing mist generating structure leading to a single exit orifice coaxial with said nozzle side wall, and wherein said first and second power nozzle lumens extend on opposite sides of the exit orifice from the nozzle sidewall inwardly to the interaction region surrounding the exit orifice.

11. The spray nozzle of claim 10, wherein said nozzle incorporates first and second exit orifices, one on each side of the central axis of the nozzle, and first and second enhanced swirl inducing mist generating structures each incorporating first and second power nozzle lumens extending on opposite sides of a corresponding exit orifice from the nozzle sidewall inwardly to the interaction region surrounding the exit orifice to produce a fluid vortex in each interaction region and two swirled spray outputs.

12. The spray nozzle of claim 11, wherein said first and second enhanced swirl inducing mist generating structures each have offset power nozzle chambers which are oppositely disposed to produce spray outputs swirling in opposite directions.

13. The spray nozzle of claim 10, wherein said nozzle incorporates multiple exit orifices in said end wall of the nozzle, and further including:

an enhanced swirl inducing mist generating structure for each said exit orifice;

each enhanced swirl inducing mist generating structure incorporating a pair of power nozzle lumens extending on opposite sides of its corresponding exit orifice and intersecting opposed sides of its corresponding interaction region at an offset angle to produce a fluid vortex in said interaction region and two swirled spray outputs from the corresponding exit orifice.

14. The spray nozzle of claim 13, wherein said first and second power nozzle lumens and said first interaction region are configured with a selected depth Pd and wherein said first and second power nozzle lumens each have a minimum width Pw at their intersection with said first interaction region;

wherein the interaction region is substantially circular with a diameter which is in the range of 1.5 to 4 times the power nozzle outlet width Pw, whereby said fluid under pressure flows from the power nozzle lumens and enters the interaction region with a higher tangential velocity $\upsilon\theta$ than the fluid entering the nozzle, setting up a fluid mist vortex comprising mostly fluid droplets with radius r and a higher angular velocity $\omega=\upsilon\theta/r$.

15. A method for generating a swirled spray with reduced coagulation and a consistently small droplet size, comprising the steps of:

(a) providing a first exit orifice aimed along a first central longitudinal spray axis, said first exit orifice defining a lumen through an end wall of a nozzle body member;

(b) forming an enhanced swirl inducing mist generating structure having a first interaction chamber surrounding an interaction region in fluid communication with said first exit orifice;

(c) forming a pair of power nozzle channels intersecting the first interaction chamber and offset with respect to its corresponding first exit orifice wherein said pair of power nozzle channels and said first interaction chamber have a substantially constant depth Pd from a power nozzle inlet and through their intersection with said first interaction region;

(d) introducing a pressurized fluid into said power nozzle channels to direct said fluid to said first interaction chamber;

(e) shaping said power nozzle channels to accelerate said fluid; and (f) generating a first fluid vortex in said first interaction chamber which exits said nozzle through said first exit orifice to produce a first swirled output spray.

16. The method of claim 15, further providing a second exit orifice in said end wall and forming a second enhanced swirl inducing mist generating structure for said second exit orifice to generate a second swirled output sprays.

17. The method of claim 16, further including aiming said second exit orifice along a second spray axis which is parallel to said first spray axis to generate multiple swirled output sprays propagating distally around parallel spray axes.

18. The method of claim 17, wherein the power nozzle channels of two adjacent enhanced swirl inducing mist generating structures are offset in opposite orientations with respect to their corresponding exit orifice axes to produce adjacent output sprays swirling in opposite directions.

19. A cup-shaped nozzle member for spray-type fluid product dispensers having a substantially cylindrical sidewall surrounding a central axis with a substantially circular distal end wall having an interior surface and an exterior, or distal, surface incorporating a central outlet, or exit aperture to provide fluid communication between the interior and exterior of the cup, comprising:

first and second fluid speed increasing venturi power nozzle channels defined in an interior surface of the distal end wall, each providing fluid communication to and terminating in a first central interaction or swirl vortex generating chamber in the end wall and surrounding the exit aperture;

each power nozzle defining a tapering channel, or lumen, of selected depth but narrowing width which terminates in a power nozzle outlet region or opening having a selected power nozzle width (Pw) at its intersection with said first interaction chamber;

said first power nozzle having an inlet which is defined in the interior surface of the distal, or end, wall proximate the nozzle cylindrical sidewall so that pressurized inlet fluid flowing into the interior of the cup and distally along the sidewall enters the first power nozzle inlet and accelerates along the tapered lumen of first power nozzle to a nozzle outlet where the fluid enters one side of said first interaction chamber;

said second power nozzle also having its inlet pressurized with said inlet fluid flowing distally along the interior of the cup and along its sidewall so that the inlet fluid enters the second power nozzle and accelerates along the tapered lumen of the second power nozzle to its nozzle outlet, where the fluid enters an opposite side of said first interaction chamber;

an interaction or swirl region is defined in the interaction chamber between the first and second power nozzle outlets and has a substantially circular section having a cylindrical sidewall coaxially aligned with the central exit aperture, or orifice, which provides fluid communication between the interaction chamber and the exterior of the cup so that spray is directed distally out along that central axis;

said first and second power nozzles being elongated, and having a depth Pd and extending from the region of the nozzle sidewall along respective axes toward the interaction region and varying in width Pw, tapering to a narrow exit region having an exit width Pw at the interaction region;

the axes of the first and second power nozzles being generally diametrically opposed, on opposite sides of the circular interaction chamber, and offset in the same direction from the central exit orifice to inject pressurized fluid into said first interaction region, either tangentially or at another selected inflow angle relative to the walls of the interaction region, the interaction region preferably being circular with a diameter which is in the range of 1.5 to 4 times the power nozzle outlet exit width Pw and being the same depth as each power nozzle, being arranged so that the fluid flows from the power nozzles and enters the interaction region tangentially, with a higher tangential velocity $\upsilon\theta$ than the fluid entering the nozzle, thereby setting up a vortex with radius r and a higher angular velocity $\omega=\upsilon\theta/r$, whereby the rapidly spinning or swirling vortex then issues from interaction region through the exit aperture to cause swirling fluid droplets that are generated in the swirl chamber to accelerate into a highly rotational flow which issues from the exit as very small droplets which are prevented from coagulating or recombining into larger droplets.

20. The cup-shaped nozzle member of claim 19, wherein said first and second power nozzle lumens and said first interaction region are configured with a selected depth Pd and wherein said first and second power nozzle lumens each have a minimum width Pw at their intersection with said first interaction region;

wherein the interaction region is substantially circular with an interaction region diameter IRd which is used to define an Offset Ratio of Pw/IRd, and wherein said Offset Ratio is in the range of 0.30 to 0.50.

21. The cup-shaped nozzle member of claim 20, wherein said Offset Ratio is 0.37.

* * * * *